US008109056B2

(12) United States Patent
Hashimoto et al.

(10) Patent No.: US 8,109,056 B2
(45) Date of Patent: Feb. 7, 2012

(54) FRAME CONSTRUCTION ARRANGEMENT FORMING AN OPENING IN A WALL OF A LOW-RISE BUILDING

(75) Inventors: Shinichiro Hashimoto, Chiyoda-ku (JP); Yoshimitsu Murahashi, Chiyoda-ku (JP); Shigeaki Tohnai, Chiyoda-ku (JP); Tatsuo Ezaki, Chiyioda-ku (JP); Atsushi Watanabe, Chiyoda-ku (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/711,045

(22) Filed: Feb. 23, 2010

(65) Prior Publication Data

US 2010/0146902 A1 Jun. 17, 2010

Related U.S. Application Data

(62) Division of application No. 11/255,246, filed on Oct. 21, 2005, now abandoned, which is a division of application No. 10/495,406, filed as application No. PCT/JP02/04966 on May 22, 2002, now abandoned.

(30) Foreign Application Priority Data

Nov. 13, 2001 (JP) ..... 2001-347119
Nov. 14, 2001 (JP) ..... 2001-348879

(51) Int. Cl.
*E04B 1/24* (2006.01)
*E04H 1/04* (2006.01)

(52) U.S. Cl. ..... 52/236.7; 52/264

(58) Field of Classification Search ..... 52/236.3, 52/236.6, 236.7, 236.8, 236.9, 262, 266, 52/264, 265
See application file for complete search history.

(56) References Cited

U.S. PATENT DOCUMENTS

| | | | | |
|---|---|---|---|---|
| 1,813,044 | A | 7/1931 | Franks | |
| 1,821,015 | A * | 9/1931 | Hull | 52/236.7 |
| 2,076,728 | A * | 4/1937 | Keller | 52/210 |
| 2,114,901 | A | 4/1938 | Henderson | |
| 3,305,989 | A * | 2/1967 | Scott | 52/236.7 |
| 3,675,385 | A | 7/1972 | Chan | |
| 4,144,686 | A | 3/1979 | Gold | |
| 4,461,130 | A * | 7/1984 | Shubow | 52/236.8 |
| 4,875,314 | A * | 10/1989 | Boilen | 52/167.1 |
| 4,918,897 | A * | 4/1990 | Luedtke | 52/742.14 |
| 5,048,257 | A * | 9/1991 | Luedtke | 52/747.1 |

(Continued)

FOREIGN PATENT DOCUMENTS

JP 5022611 3/1975

(Continued)

OTHER PUBLICATIONS

U.S. Appl. No. 10/495,406: Mar. 2, 2011 Final Office Action.

(Continued)

*Primary Examiner* — Michael Safavi
(74) *Attorney, Agent, or Firm* — Baker Botts LLP

(57) ABSTRACT

A frame construction for a low rise building. In the construction, a wall frame panel is made of thin light-gauge section steel by bonding together a surface member, a lower frame member, vertical frame members and an upper frame member. Roof or floor support girders are made of heavyweight section steel having H-shape or channel shape. The girders are coupled to frame construction panels by bolts or hold-down fasteners.

2 Claims, 21 Drawing Sheets

U.S. PATENT DOCUMENTS

| | | | | |
|---|---|---|---|---|
| 5,113,631 | A * | 5/1992 | diGirolamo et al. | 52/236.8 |
| 5,333,426 | A * | 8/1994 | Varoglu | 52/236.7 |
| 5,402,612 | A * | 4/1995 | diGirolamo et al. | 52/241 |
| 5,782,047 | A * | 7/1998 | De Quesada | 52/236.6 |
| 6,298,612 | B1 * | 10/2001 | Adams | 52/167.3 |
| 6,298,617 | B1 * | 10/2001 | de Quesada | 52/236.3 |
| 6,460,297 | B1 * | 10/2002 | Bonds et al. | 52/79.1 |
| 6,523,322 | B1 * | 2/2003 | Michalski et al. | 52/745.05 |
| 6,623,322 | B1 * | 9/2003 | Lesniak | 441/38 |
| 2002/0170243 | A1 * | 11/2002 | Don et al. | 52/79.7 |
| 2003/0024174 | A1 * | 2/2003 | Bonds et al. | 52/79.1 |
| 2004/0200172 | A1 * | 10/2004 | Beck et al. | 52/506.03 |
| 2010/0037546 | A1 * | 2/2010 | Beck et al. | 52/282.4 |

FOREIGN PATENT DOCUMENTS

| | | |
|---|---|---|
| JP | 01260152 | 10/1989 |
| JP | 06336776 | 12/1994 |
| JP | 09-060156 | 3/1997 |
| JP | 09273248 | 10/1997 |
| JP | 10311110 | 11/1998 |
| JP | 3055431 | 1/1999 |
| WO | WO 03042467 | 5/2003 |

OTHER PUBLICATIONS

U.S. Appl. No. 10/495,406: Dec. 21, 2010 Decision on Petition to Revive.
U.S. Appl. No. 10/495,406: Nov. 9, 2010 Petition to Revive and Response to Non-Final Office Action.
U.S. Appl. No. 10/495,406: Jun. 23, 2010 Notice of Abandonment.
U.S. Appl. No. 10/495,406: Sep. 12, 2008 Decision on Petition to Revive.
U.S. Appl. No. 10/495,406: Jun. 30, 2008 Petition to Revive.
U.S. Appl. No. 10/495,406: May 22, 2008 Notice of Abandonment.
U.S. Appl. No. 10/495,406: Feb. 4, 2008 Notice of Non-Compliant.
U.S. Appl. No. 10/495,406: Nov. 15, 2007 Response to Non-Final Office Action.
U.S. Appl. No. 10/495,406: Oct. 17, 2007 Notice of Non-compliant Amendment.
U.S. Appl. No. 10/495,406: Jul. 26, 2007 Response to Non-Final Office Action.
U.S. Appl. No. 10/495,406: Feb. 26, 2007 Non-Final Office Action.
U.S. Appl. No. 10/495,406: Feb. 8, 2007 RCE/Response to Final Office Action.
U.S. Appl. No. 10/495,406: Aug. 7, 2006 Final Office Action.
U.S. Appl. No. 10/495,406: May 18, 2006 Response to Non-Final Office Action.
U.S. Appl. No. 10/495,406: Nov. 14, 2005 Non-Final Office Action.
U.S. Appl. No. 11/255,246: Apr. 12, 2010 Notice of Abandonment.
U.S. Appl. No. 11/255,246: Feb. 8, 2010 Advisory Action.
U.S. Appl. No. 11/255,246: Jan. 25, 2010 Response to Final Office Action.
U.S. Appl. No. 11/255,246: Sep. 24, 2009 Final Office Action.
U.S. Appl. No. 11/255,246: Jun. 15, 2009 Response to Non-Final Office Action.
U.S. Appl. No. 11/255,246: May 20, 2009 Notice of Non-compliant Amendment.
U.S. Appl. No. 11/255,246: Jan. 15, 2009 Response to Non-Final Office Action.
U.S. Appl. No. 11/255,246: Jul. 15, 2008 Non-Final Office Action.
U.S. Appl. No. 11/255,246: Jun. 30, 2008 RCE / Response to Final Office Action.
U.S. Appl. No. 11/255,246: Dec. 28, 2007 Final Office Action.
U.S. Appl. No. 11/255,246: Oct. 9, 2007 Response to Non-Final Office Action.
U.S. Appl. No. 11/255,246: Sep. 14, 2007 Notice of Non-compliant Amendment.
U.S. Appl. No. 11/255,246: Jul. 9, 2007 Response to Non-Final Office Action.
U.S. Appl. No. 11/255,246: Feb. 8, 2007 Non-Final Office Action.
U.S. Appl. No. 12/729,395: Mar. 30, 2011 Final Office Action.
U.S. Appl. No. 12/729,395: Dec. 28, 2010 Response to Non-Final Office Action.
U.S. Appl. No. 12/729,395: Jun. 28, 2010 Non-Final Office Action.

* cited by examiner

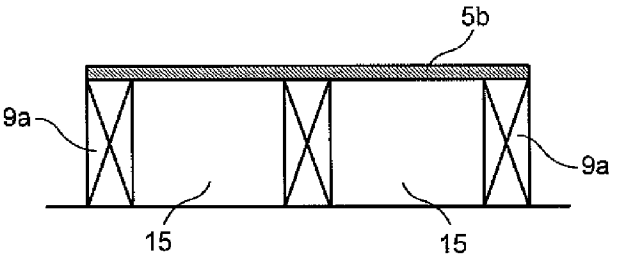
FIG. 7A
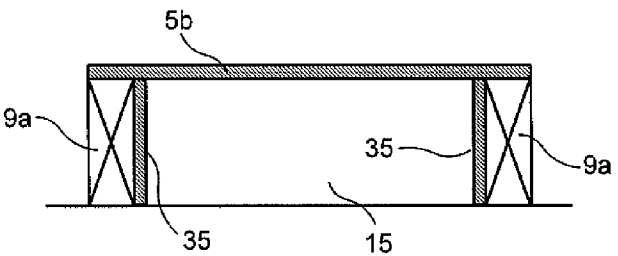
FIG. 7B
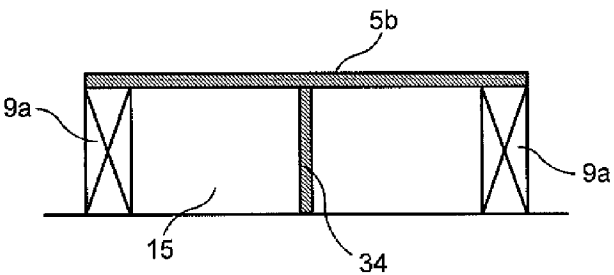
FIG. 7C
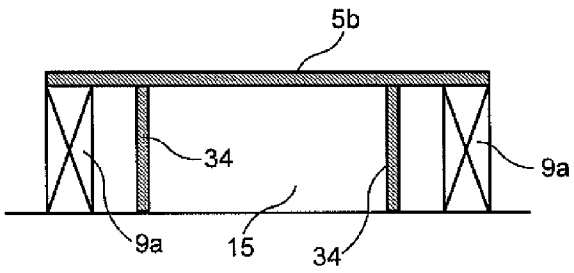
FIG. 7D
FIG. 7E
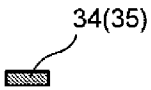
FIG. 7F

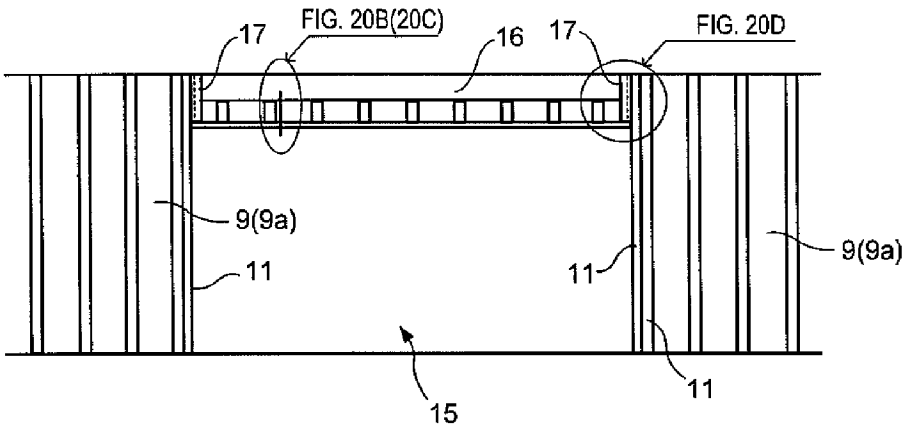
F I G. 20A
PRIOR ART
F I G. 20B
PRIOR ART
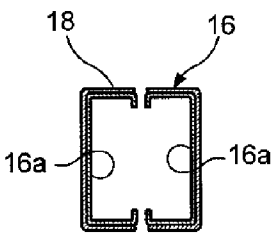
F I G. 20C
PRIOR ART
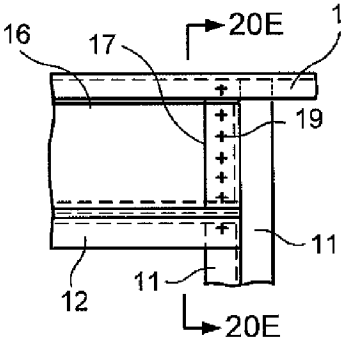
F I G. 20D
PRIOR ART
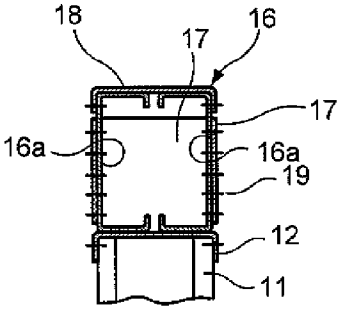
F I G. 20E
PRIOR ART

FRAME CONSTRUCTION ARRANGEMENT FORMING AN OPENING IN A WALL OF A LOW-RISE BUILDING

CROSS-REFERENCE TO RELATED APPLICATION(S)

This application is a division of U.S. patent application Ser. No. 11/255,246 filed Oct. 21, 2005 now abandoned which is a divisional of U.S. patent application Ser. No. 10/495,406 filed May 12, 2004 now abandoned as a national phase application of International patent application No. PCT/JP02/04966 filed on May 22, 2002 (published as WO 03/031669) claiming priority to Japanese patent application Nos. JP 2001347119 and JP 2001348879 that were filed on Nov. 13, 2001 and Nov. 14, 2001, respectively. This application claims the benefit under 35 U.S.C. §119 and §235 of all of the aforementioned applications, all of which applications are incorporated by reference herein in their entireties.

FIELD OF THE INVENTION

The present invention relates to a frame construction for a low-rise building of one to three stories having a large opening such as a doorway or a window, and/or for a large span low-rise building of, e.g., one to three stories having a large opening such as a doorway or a window.

BACKGROUND INFORMATION

While a steel frame work method (hereinafter referred to as a first prior art method) has been mainly employed as a construction method for a low-rise building of one to three stories in the prior art, a steel house construction method has recently been prevalent. In this regard, the steel house is defined as a building of a steel panel structure composed of frame members made of thin lightweight section steel and construction surface members or braces. This construction method is referred to as a second prior art method hereinafter.

An example of a single-storied building constructed by the first prior art method (the steel frame work method) is illustrated in FIGS. 16 to 18. Individual footings 1 and a floor (a stall) 2 are constructed from concrete.

Columns 3 made of steel frame are facilitated on the individual footings 1 and wall substrates 4 are provided. Beams 5 of H-shaped steel are mounted to the upper ends of the columns 3, and girders 5*a* are bridged between the left and right beams 5, by which beams and girders a roof 6 is supported. In this regard, in FIGS. 17 and 18, reference numeral 4*a* denotes a wall and 7 denotes a doorway (e.g., an opening).

The features of the first example are as follows. A material cost for the roof is low; the number of parts is low; manufacturing is easy; site work is easy in that one day is sufficient for erecting a building for a convenience store or the like; the opening is freely prepared (if necessary, studs may be used in accordance with a width of the opening); and only cutting of the constituent members is needed. However, drawbacks thereof are that the precision of execution of work is liable to vary; LGS (light-gage steel) is necessary as a substrate for finishing the wall; and site work needs two days.

FIGS. 19 to 21 illustrate another example of a single-storied building for a convenience store or the like constructed by the second prior art method (the steel house (SH) method). A continuous footing 8 and a floor (a stall) 2 are constructed from concrete, and wall frame panels 9 made of thin light-gauge section steel are stood on the continuous footing 8.

As shown in FIG. 21, the wall frame panel 9 is formed by standing vertical frame members 11 of thin light-gauge section steel on a lower frame member 10 of thin light-gauge section steel, placing an upper frame member 12 of thin light-gauge section steel on the vertical frame members 11, and fixing a construction surface member 13 to the respective frame members with drill screws 19. Hereinafter, the product obtained by fixing the construction surface member 13 to the respective frame members is referred to as an SH panel 9.

Further, a truss 14 of thin light-gauge section steel (hereinafter referred to as an SH truss) is assembled to be supported by the wall frame panel 9, and a roof 6 is supported by the SH truss 14. In FIG. 20(A), reference numeral 15 denotes a relatively large opening (e.g., a window or a doorway).

As shown in FIG. 20(A), both ends of a lintel 16 are fixed to the vertical frame members 11 via lintel brackets 17 above the opening 15 for transmitting a vertical load from the roof to the wall frame panel 9. FIGS. 20(B) and 20(C) illustrate examples of the lintel 16, in which lipped channels 16*a* of thin steel sheet are opposed to each other and the outside thereof is reinforced with a reinforcement channel(s) 18.

FIGS. 20(D) and 20(E) illustrate another example, in which opposite flanges of the lintel bracket 17 of a U-shaped thin steel plate as seen in a plan view are brought into contact with lateral sides of an end of the lintel 16 and fixed to each other with drill screws 19, and a web is brought into contact with a back side of the vertical frame members 11 and fixed to each other with drill screws 19.

In such a manner, the steel house is constructed by using the frame members of thin light-gauge section steel as main frame elements, to which wood frame members are partially combined or a surface member of plywood is used as a construction surface member if necessary.

The frame member of thin light-gauge section steel is formed by shaping a thin steel sheet of approximately 1 mm thick, through roll-forming, to be a channel, a lipped channel or a box so that a width or others thereof is matched with a predetermined specification.

A further example of a frame construction according to the second prior art method is illustrated in FIGS. 22 to 25. A plurality of vertical frame members 11 are provided from lower frame members 10 at a distance between the adjacent ones thereof, and the upper ends of the respective vertical frame members 11 are coupled by upper frame members 12.

Wall frame panels (force-resisting wall panels) 9 are formed by attaching construction surface members 13 (see FIGS. 24 and 25) or braces to the wall frame members constructed by the lower frame members 10, the vertical frame members 11 and the upper frame members 12. Openings 15 such as a doorway 7 or a window 7*a* are formed in the building.

Side beams 5*b* and end beams 5*c* are supported by the upper frame members 12 of the wall frame panel (force-resisting wall panel) 9 so that both the beams are combined to form a rectangle. A plurality of beams 5*c* of various lengths are provided in parallel to the side at a predetermined distance.

Opposite ends of the longer beam 5*d* are coupled to the front and rear end beams 5*c* via brackets 20, while one end of the shorter beam 5*d* is coupled to the front or rear end beam 5*c* and the other end thereof is coupled to a girder 5*a* via brackets 11, respectively.

One end of the girder 5*a* is coupled to the side beam 5*b*, while the other end thereof is coupled to the longer beam 5*d* via the brackets 20, respectively. A floor panel 2 is constructed by covering the beams 5*d* with the construction surface members 13 of plywood or the like.

In FIG. 22, reference numeral 5*e* denotes an end beam in the floor opening, 5*f* denotes a side beam in the opening, 20*a* denotes a beam bracket, and 20*b* denotes a cleat.

In the above-mentioned building according to the SH method, as there are no vertical frame members 11 in the opening 15 such as a doorway 7 or a window 7*a*, no columns exist in the opening 15, for supporting a vertical load from the upper portion of the building such as a roof, resulting in the deterioration of strength in the opening 15.

Therefore, it may be necessary to reinforce the upper portion above the opening 15. Thus, the lintel 16 is provided above the opening 15.

As shown in FIG. 22, an upper frame member 12 and a lintel frame member 16*b* are provided above and beneath the lintel 16 of the window 7*a*, respectively.

Upper frame members 12*a* of the opening are provided between the lintel frame member 16*b* and upper frame member 16*c* of the window, and opposite ends of the lintel 16 are attached to lintel receiving members 16*d* via the lintel brackets 17, and vertical frame members 11*a* for attaching the lintel brackets are coupled to the vertical frame members 11 at ends of the force-resisting wall 9 by drill screws 19. Reference numeral 7*b* denotes a window base, 7*c* denotes a window base, and 10*a* denotes a lower frame member of the opening.

FIG. 24 schematically illustrates an opening 15 of a building formed of a ground floor portion 36 constructed by the SH method and a second floor portion 37 placed on the former, and FIG. 25 illustrates a section taken along a line A-A in FIG. 24. Each of the drawings shows a connection structure between the lintel 16, the end beam 5*c* and the beam 5*d*. An end of the beam 5*d* having the bracket 20 is coupled to the end beam 5*c* made of thin light-gauge section steel.

The bracket 20 is formed by cutting a lipped channel of thin light-gauge section steel into short pieces and disposing it so that the channel portion is in the vertical direction. The lintel 16 arranged beneath the end beam 5*c* and coupled thereto by drill screws is formed by opposing the lipped thin light-gauge channels 16*a* to each other and fixing the upper and lower sides thereof by connection frame members 16*d*.

According to the second prior art method (the steel house (SH) method), a skeleton is constructed of the force-resisting wall panels (SH panels) constructed by the wall frame members which are formed by assembling the frame members of thin light-gauge section steel by using the drill screws and are coupled to the construction surface members also by using the drill screws. The merit thereof is that the thin light-gauge section steel necessitates no welding, and is easily cut and drilled, as well as it also being light in weight and capable of being manually conveyed, whereby the working efficiency is high and the manufacturing cost is low.

The merit of the force-resisting wall panel (SH panel) is that the accuracy of the product is stable and prefabrication of the panel is possible, whereby the execution of work becomes easy due to the shortening of construction period and the maintenance of panel accuracy.

For example, in a single-storied building for a convenience store, the period of erection is half of a day, and in a two or three storied building of approximately 99 to 132 $m^2$, the period of erection is two days. Accordingly, this construction method is economical in the field of low-rise buildings.

The second prior art method (steel house (SH) method), however, has the following drawbacks. For example, in the building for a convenience store or the like, it is required that a large opening is formed on the wall surface and the number of columns is reduced to as small as possible to ensure a large space.

That is, in the building, when a roof of large span is constructed in correspondence to a required large span of several meters or longer, as the cross-section of the thin light-gauge section steel is small, the strength thereof is too weak to support a load from the roof solely by the end members. Thereby, it is necessary to construct a roof truss consisting of a plurality of members.

In the above-mentioned roof truss, the number of parts increases, the number of portions to be coupled by drill screws or bolts increases, and an area of the side surface wall increases, which are uneconomical because of the increase in man-hours. Also, when it is required to guarantee a large room space, the second prior art method could not respond to a case in which the span between supports of the roof is as large as ten or more meters.

In the low-rise building of 2 to 3 stories constructed by thin light-gauge section steel, as an opening such as a doorway or a window formed on the wall surface lacks the strength for supporting the vertical load applied from above, the lintel is provided in the upper portion of the opening to distribute the vertical load, applied to the opening from above, to the opposite vertical frames of the force-resisting wall panel.

The lintel is required to have a strength capable of withstanding a vertical load, from above, such as the load of a roof or a floor. Thereby, the lintel preferably uses a member in which a plurality of thin light-gauge section steel pieces are combined to result in the complexity of the manufacture and construction of the lintel.

Further, when the opposite ends of the lintel are attached to the side ends of the force-resisting wall panel disposed on both sides of the opening, the attachment of the lintel to the peripheral members becomes complex in relation to complexity in the structure of the lintel. Further, the height of the opening (i.e., reference h provided in FIG. 24) can be restricted due to the existence of the lintel.

SUMMARY OF THE INVENTION

One of the objects of the present invention is to provide a frame construction for a low-rise building in which the above-mentioned problem has been solved. For example, such frame construction may be preferably free from the drawbacks of the SH method while maintaining the advantages of a steel house for a low-rise building (for example, a single or two to three-storied building for a convenience store), which partially adopts a heavyweight steel frame structure (hereinafter referred to as a mixed construction) or a frame member construction consisting of a plurality of thin light-gauge section steels coupled together (hereinafter referred to as a composite construction).

Further, another object of the present invention is to provide frame construction which maintains the advantage of the frame members of thin light-gauge section steel used in the SH method in that it is light in weight and capable of being manually conveyed; and eliminating the drawback thereof in that it is inferior in strength, by combining the same with heavyweight section steel which is inferior in execution property and heavy in weight.

Thus, the frame construction for the low-rise building is provided, having features of both the frame member made of thin light-gauge section steel and the heavyweight section steel.

For example, in the low-rise building, the lintel is generally not used in the opening, but the force-resisting wall panel and the roof panel or the floor panel can be coupled together via the girder provided in the upper portion of the force-resisting wall panel. As a result, a frame construction is provided, which require no time for processing the lintel and is free from a restriction in the height of the opening.

According to one exemplary embodiment of the present invention, a frame construction for a low-rise building is provided. In particular, a wall frame panel structured from a lower frame member, an upper frame member and vertical frame members of thin light-gauge section steel is coupled to a girder of heavyweight steel provided at the upper end of the wall frame panel by a coupling arrangement comprising bolts and/or hold-down fasteners. A reinforcement steek column may also be provide.

The wall frame panel can be structured by fixing a construction surface member or a brace to the lower frame member, the upper frame member and the vertical frame members. The girder may be formed of channel steel, and the channel steel can be coupled to the upper frame member of the wall frame panel by bolts. The girder may also be formed of H-shaped steel, and the H-shaped steel is coupled to the upper frame member of the wall frame panel by bolts. For example, the channel steel may be coupled to the upper fram member of the wall fram panel by nolts via a hold down fastener disposed so that a horizontal member is on the upper side, and/or the H-shaped steel can be coupled to the upper fram member of the wall fram panel by bolts via a hold-down fastener disposed so that a horizontal member is on the upper side.

According to yet a further embodiment of the present invention, in the low-rise building constructed by the SH method using frame members of thin light-gauge channel steel, the problem of the thin light-gauge section steel, that it is weak in mechanical strength and inferior in processibility, may be solved by combining the same with heavyweight section steel, while maintaining the merit thereof in that it is light in weight and capable of being manually conveyed, it is possible to smoothly support a roof load by a simple construction based on the steel house method without using a complicated structure such as a roof truss or others.

It may be advantageous to have a large opening present on the wall surface and a large space is obtained in the building by decreasing the number of columns as much as possible. For this purpose, a large span of several meters or more is required. According to still another exemplary embodiment of the present invention, a building such as a convenience store which may need such a large span can be reasonably constructed. Indeed, the exemplary embodiments of the present invention may solve the following problem which may be inherent to the steel house method: e.g., (i) a cost for constructing a roof is high because it may be necessary to form a truss in the roof portion because the cross-section of the frame member of thin light-gauge channel is thin, resulting in the inferior strength, and the frame member of thin light-gauge section steel is unsuitable for a structure for supporting the roof by a large span of ten or more meters or more when a large room space may be desired.

Also, the coupling method can be useful for smoothly transmitting a force between the horizontal member of heavyweight steel frame for supporting the roof and the assembled panel of thin steel frames.

According to yet another exemplary embodiment of the present invention, a force may be transmitted as an axial force to vertical frame members of the assembled panel of thin steel frames, whereby the arrangement can be durable against a large withdrawing force.

For example, the frame construction can include a wall frame panel formed of frame members of thin light-gauge section steel and attached to a construction surface member or a brace, and a girder that is provided above the wall frame panel for supporting a floor panel or a roof. The girder may be formed of section steel and coupled to the force-resisting panel and/or the floor panel by bolts, and a lintel is not needed above the opening so that the opening extends to directly beneath the girder. In addition, a reinforcement member can be provided in a channel of the girder formed of section steel.

According to a further exemplary embodiment of the present invention, the frame construction having an opening in a wall thereof includes a wall frame panel (formed of frame members of thin light-gauge section steel) attached to a construction surface member or a brace, as well as a girder provided above the wall frame panel for supporting a floor panel or a roof. In this exemplary embodiment, the frame construction can be formed from a plurality of thin light-gauge section steel members assembled together and coupled to the force-resisting panel and/or the floor panel by bolts, and the lintel does not have to be provided above the opening so that the opening extends to directly beneath the girder. In addition a reinforcement member can be provided in a channel of the girder formed of the assembled members.

According to another exemplary variant of the present invention the girder, provided on the wall surface having the opening extending parallel to beams, can be formed of a channel steel disposed so that the web thereof extends in the vertical direction, and a lateral side of the beam is brought into contact with a back surface of the web of the channel steel and coupled to the latter by bolts.

In another variant of the present invention, the girder, provided on the wall surface having the opening extending parallel to beams, can be formed of an H-shaped steel disposed so that the web thereof extends in the vertical direction, and a lateral side of the beam is brought into contact with a web surface of the H-shaped steel and coupled to the latter by bolts. According to yet another variant of the present invention, the girder, provided on the wall surface having the opening extending vertical to beams, may be formed of a channel steel disposed so that the web thereof extends in the vertical direction, and an end of the beam is placed on the upper surface of the upper flange of the channel steel and coupled to the latter by bolts.

Further, the girder, provided on the wall surface having the opening extending vertical to beams, can be formed of a H-shaped steel disposed so that the web thereof extends in the vertical direction, and an end of the beam is placed on the upper surface of the upper flange of the H-shaped steel and coupled to the latter by bolts. The assembled members of thin light-gauge section steel constituting the girder, provided on the wall surface having the opening extending parallel to beams, may be disposed so that the web thereof extends in the vertical direction, and a lateral side of the beam is brought into contact with the inner surface of the web and coupled to the latter by bolts.

Alternatively, the assembled members of thin light-gauge section steel constituting the girder, provided on the wall surface having the opening extending vertical to beams, axe can be disposed so that the web thereof extends in the vertical direction, and an end of the beam is brought into contact with the upper surface of the upper surface of the respective upper flange of the assembled member and coupled to the latter by bolts.

According to a still further exemplary embodiment of the present invention, by constituting the girder disposed above the force-resisting wall panel with heavyweight steel such as H-shaped steel or channel steel, or the assembled members of thin light-gauge channel steel, it is possible to eliminate the lintel in the low-rise building, whereby it is possible to enlarge the height and width of the opening due to the elimination of lintel, while maintaining the advantage of the method for constructing the steel house mainly formed of frame members of thin light-gauge section steel in that no welding is necessary, cutting and boring are simple, the working efficiency is high, because the material is light in weight and can be manually conveyed, the force-resisting wall panel, the roof and the floor panel are efficiently manufactured in the factory at a high accuracy, the site work is simplified, the construction period is short, and the manufacturing cost is low.

BRIEF DESCRIPTION OF THE DRAWINGS

FIG. 7(A) is an illustration of a first combination of the SH panel and the heavyweight steel frame members with the peripheral beams;

FIG. 7(B) is an illustration of a second combination of the SH panel and the heavyweight steel frame members with the peripheral beams;

FIG. 7(C) is an illustration of a third combination of the SH panel and the heavyweight steel frame members with the peripheral beams;

FIG. 7(D) is an illustration of a fourth combination of the SH panel and the heavyweight steel frame members with the peripheral beams;

FIG. 7(E) is an illustration of the SH panel of the heavyweight steel frame;

FIG. 7(F) is an illustration of the peripheral beam of the heavyweight steel frame;

FIG. 20(A) is front view of a structure as provided in the direction S shown in FIG. 19, showing an opening of the single-storied building;

FIG. 20(B) is an illustration of a first example of a portion P of the combination of window lintel shown in FIG. 20(A);

FIG. 20(C) is an illustration of a second example of the portion P of the combination of window lintel shown in FIG. 20(A);

FIG. 20(D) is a front view of a portion T of a lintel bracket shown in FIG. 20(A);

FIG. 20(E) is a side view of the portion T of the lintel bracket shown in FIG. 20(A);

DETAILED DESCRIPTION

Figure 1A:
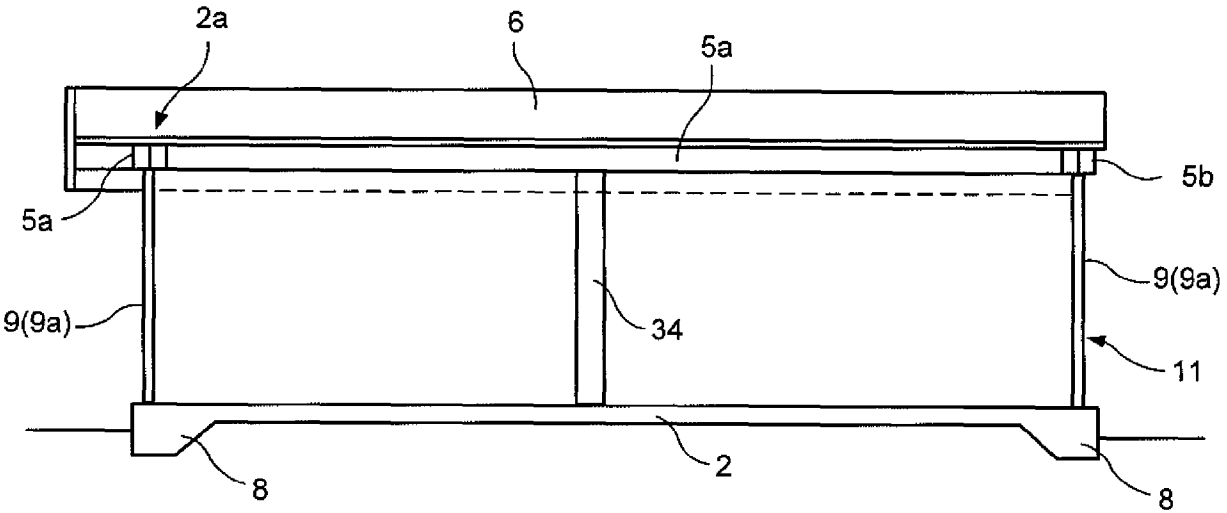
FIG. 1(A) is a sectional view of a single-storied building of a mixed construction consisting of SH panels formed of frame members and surface members of thin light-gauge section steel and a girder of a heavyweight steel frame.

Exemplary embodiments of the present invention will be described with reference to the attached drawings, in which the same reference numerals are used for denoting the same elements.

Figure 1B:
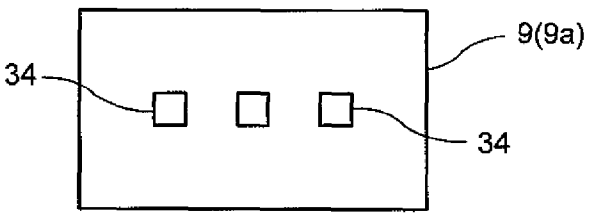
FIG. 1(B) is a plan view of the single-storied building of FIG. 1(A)

A first exemplary embodiment of the present invention is illustrated in FIGS. 1 to 4. FIG. 1 illustrates one example of a single-storied building of a size used for a convenience store or the like, constructed by the steel house (SH) method.

Figure 21:
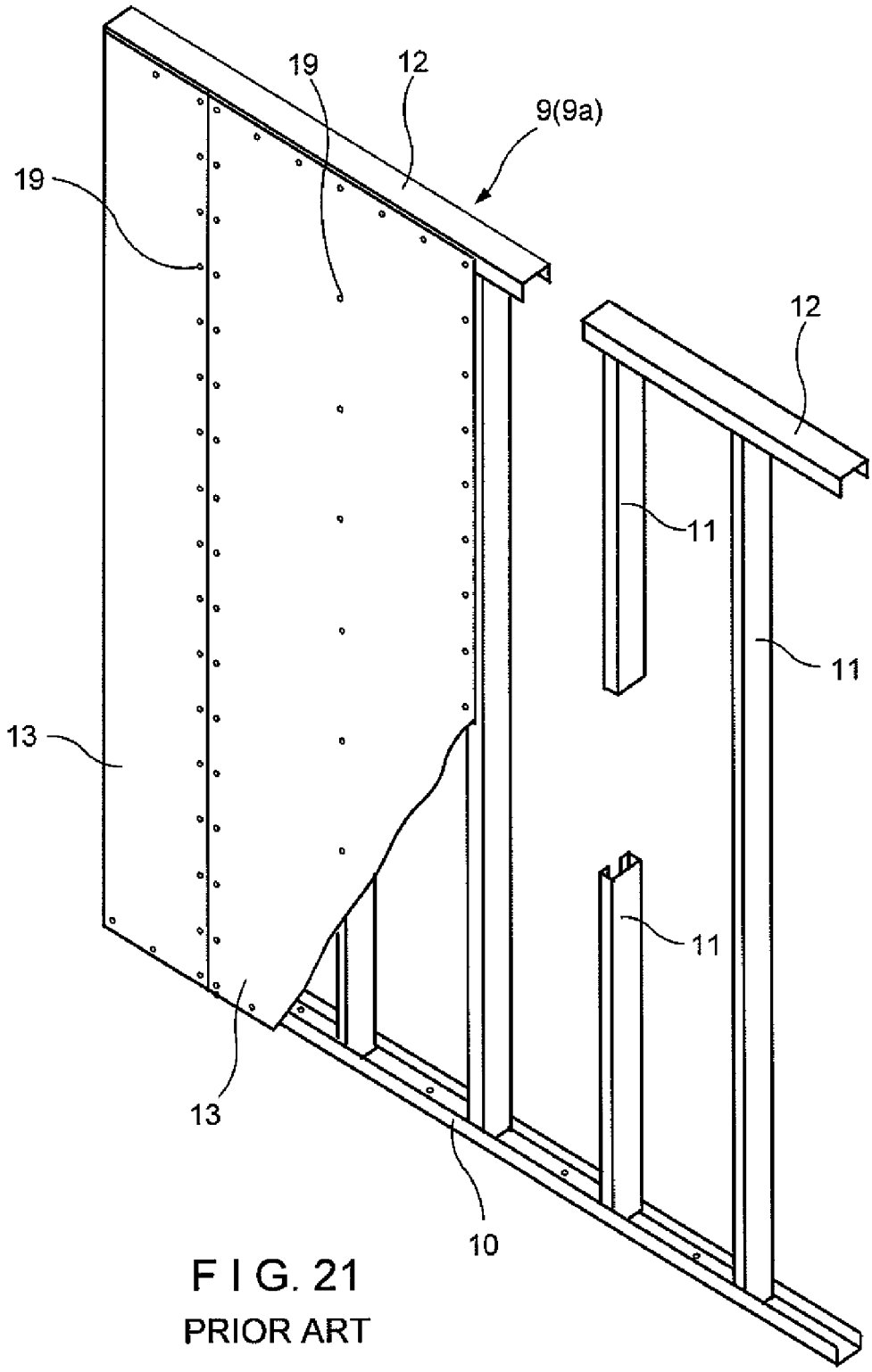
F I G. 21 PRIOR ART
FIG. 21 is an illustration of an SH panel formed of wall frame panels of thin steel sheet coupled to construction surface members.
Figure 22:
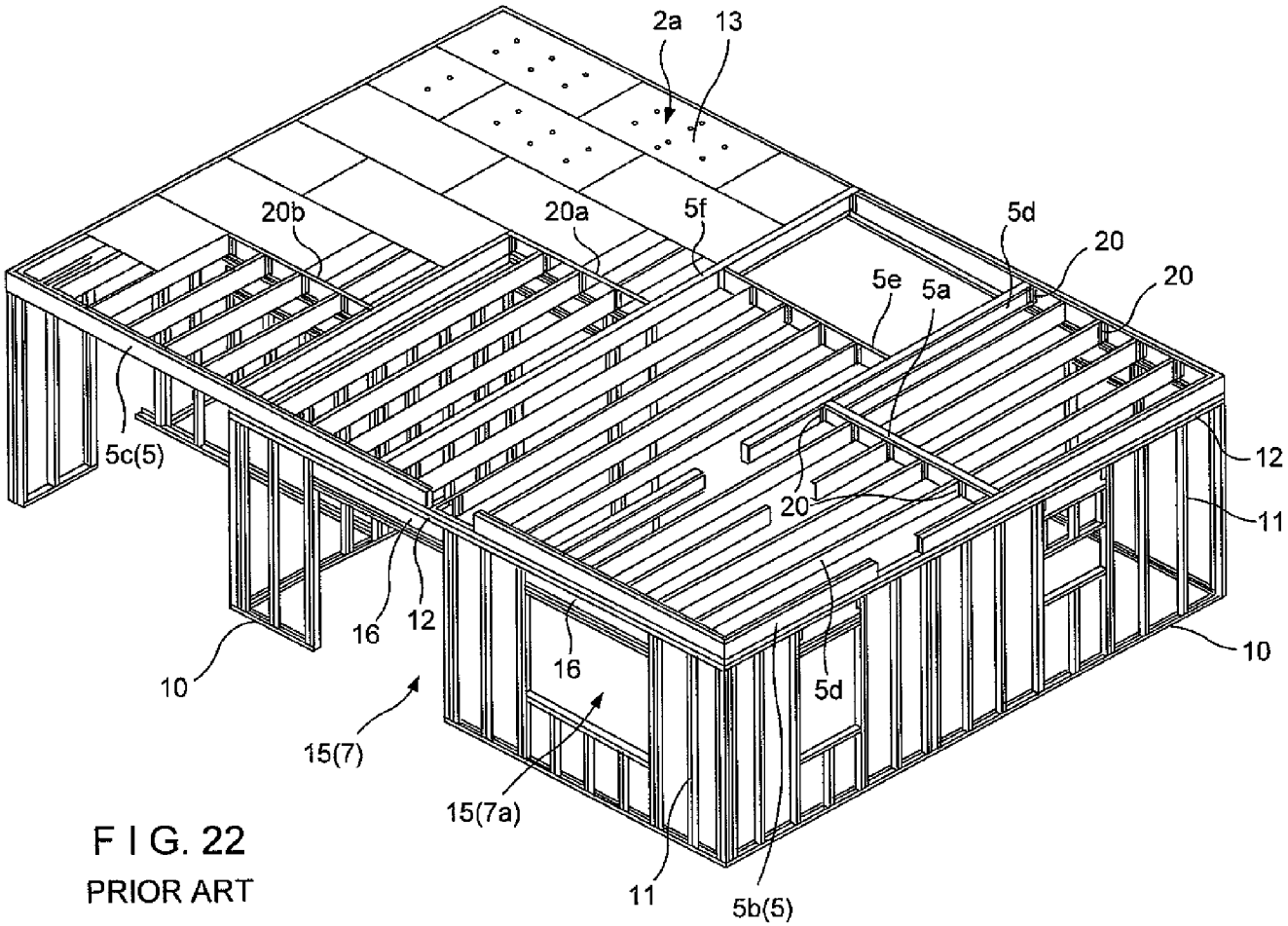
F I G. 22 PRIOR ART
FIG. 22 is an illustration of a frame construction of a ground floor portion of a steel house.
Figure 23B:
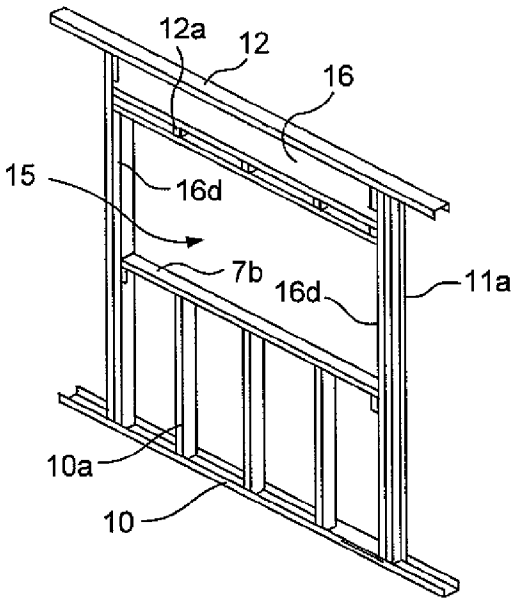
F I G. 23B PRIOR ART
FIG. 23(B) is an illustration of the assembled window frame of FIG. 23(A)
Figure 23A:
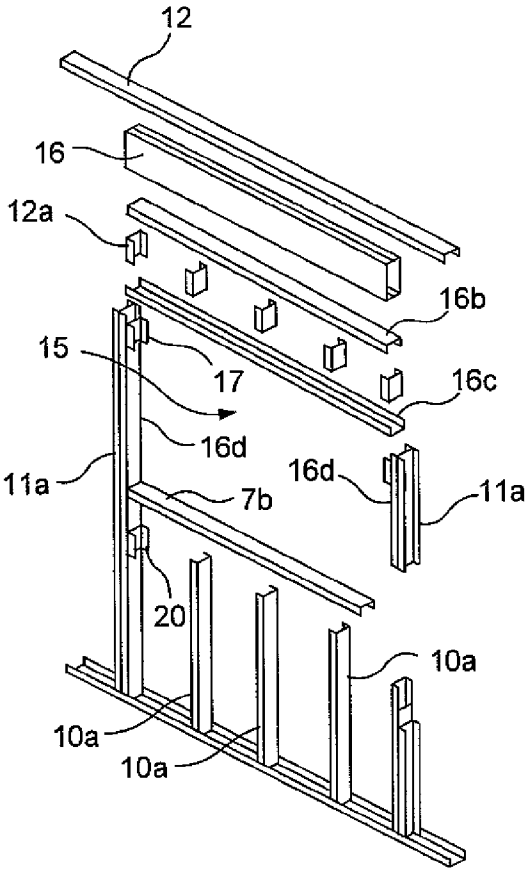
F I G. 23A PRIOR ART
FIG. 23(A) is an exploded view of a construction of a window frame.
Figure 24:
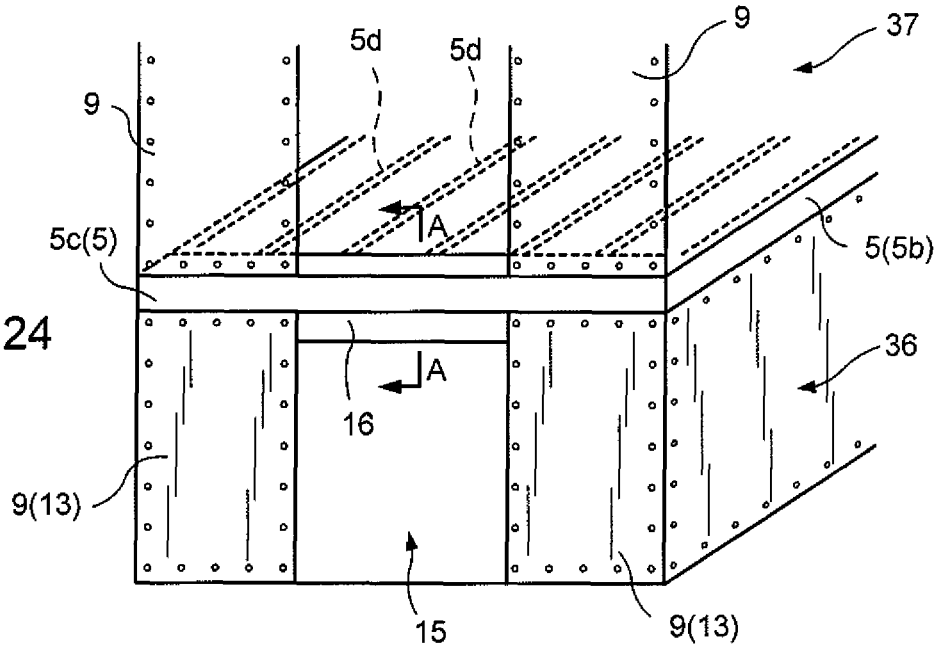
FIG. 24 is an illustration of a low-rise building constructed by a conventional steel house method.
Figure 25:
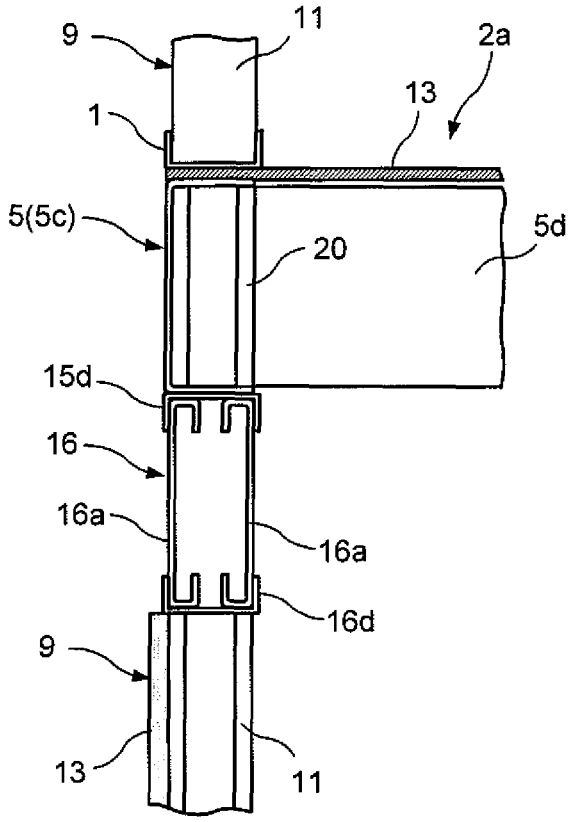
FIG. 25 is a sectional view taken along a line A-A shown in FIG. 24.

A continuous footing 8 and a floor (stall) 2 are formed by placing concrete, and wall frame panels 9 of thin light-gauge section steel are stood on the continuous footing 8. A structure of the wall frame panel 9 can be the same as shown in FIG. 21; i.e., the wall frame panel 9 is formed by standing vertical frame members 11 of thin light-gauge section steel on a lower frame member 10 of thin light-gauge section steel, placing an upper frame member 12 of thin light-gauge section steel on the vertical frame members 11, and fixing a construction surface member 13 to the respective frame members with drill screws 19. This wall frame panel may be called a SH panel 9*a*.

Peripheral beams 5*b* of heavyweight steel frame such as heavyweight section steel are provided at the upper end of the SH panel, and girders 5*a* of H-shaped steel are bridged between the left and right peripheral beams disposed at a predetermined distance, by which horizontal beams is supported a roof 6. In this regard, in FIG. 1, reference numeral denotes 34 a stud for reinforcement.

In the above structure, a coupling method is important, for smoothly transmitting a force between the wall frame panel 9 of thin steel sheet and the peripheral beam 5*b* of heavyweight steel frame. Provided below is an explanation thereof.

Figure 2A:
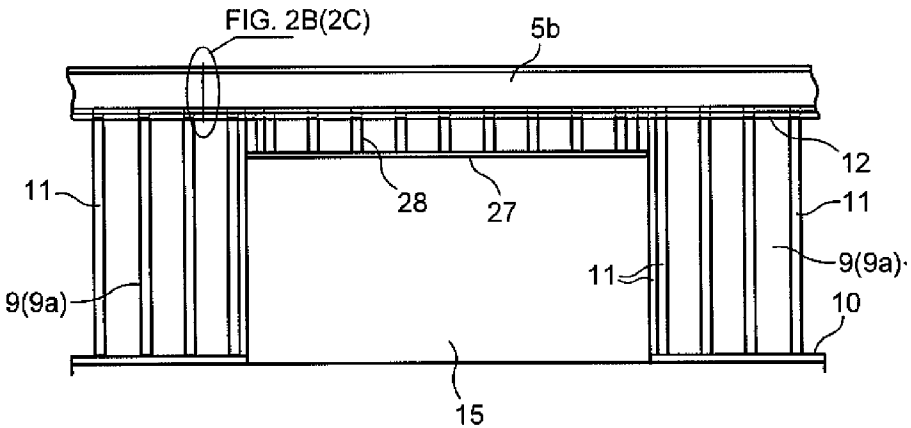
FIG. 2(A) is an enlarged view of a portion Q shown in FIG. 1, which illustrates a front of an opening of the single-storied building.
Figure 2D:
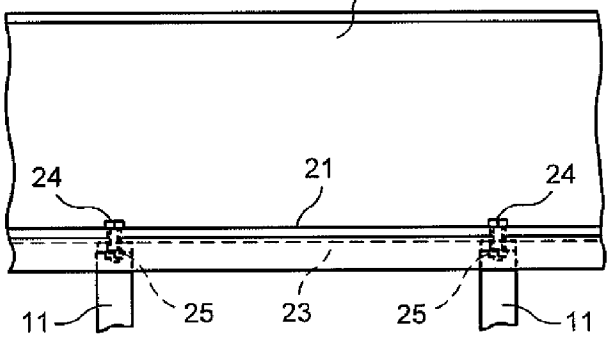
FIG. 2(D) is a side view of the first and second examples shown in FIGS. 2(B) and 2(C)
Figure 2C:
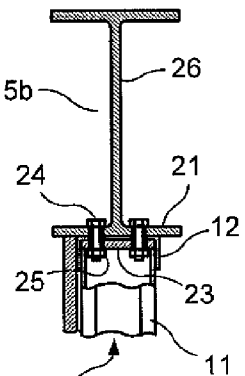
FIG. 2(C) is an enlarged view of a portion R shown in FIG. 2(A) illustrating a second example of the coupling between the SH panel and the peripheral beam.
Figure 2B:
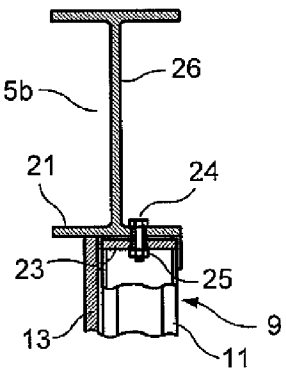
FIG. 2(B) is an enlarged view of a portion R shown in FIG. 2(A) illustrating a first example of the coupling between the SH panel and the peripheral beam.
Figure 3:
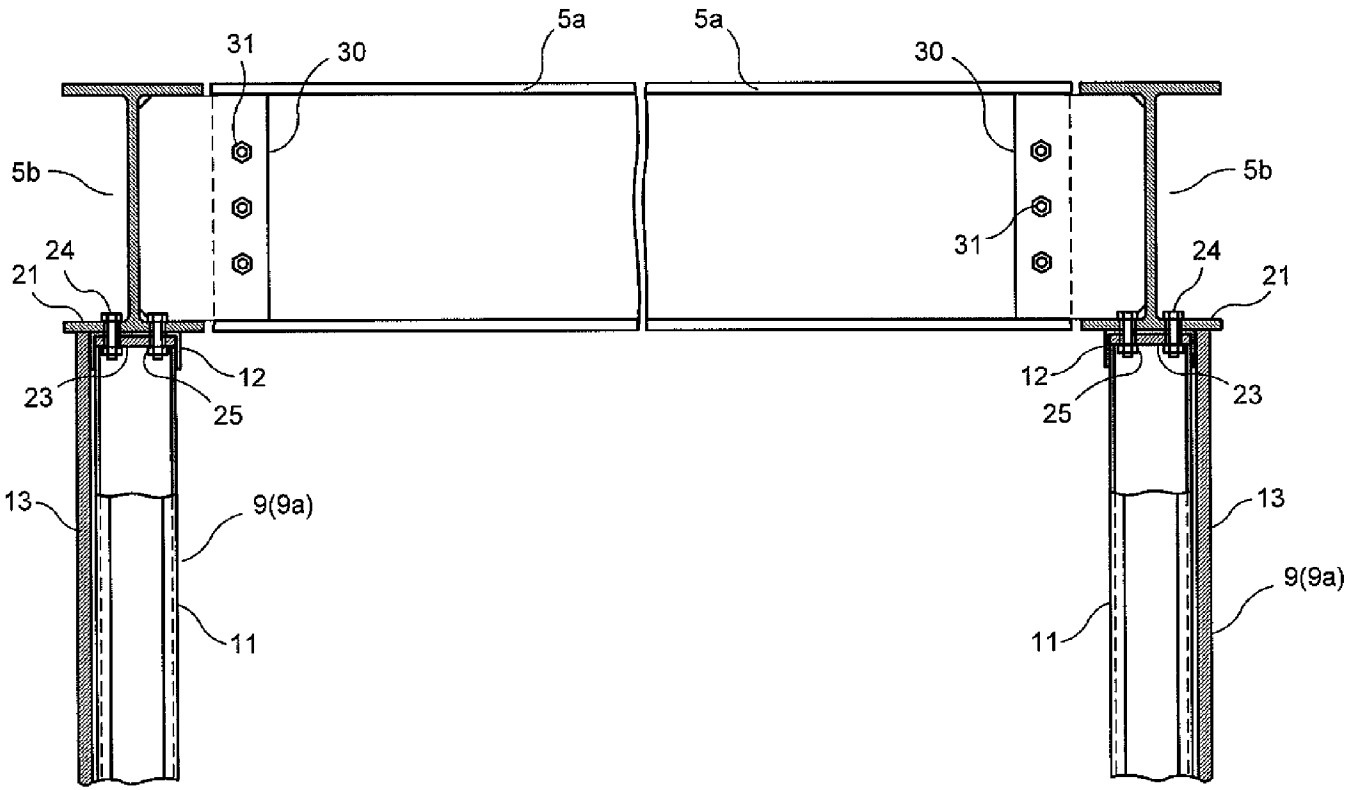
FIG. 3 is an exemplary illustration of a coupling of the SH panel and the beams (e.g., the peripheral beams and the girder) in correspondence to FIG. 2(C)

According to a first exemplary embodiment of the present invention in which the peripheral beam 5*b* is formed of H-shaped steel, as shown in FIGS. 2 and 3, an upper frame member 12 of thin steel sheet is disposed downward at the upper ends of the vertical frame members 11 so that the upper ends of the plurality of vertical frames 11 are fixed together.

Further, the lower surface of a lower flange 21 of the peripheral beam 5*b* of H-shaped steel is brought into contact with the upper surface of a web of the upper frame member 12, and a reinforcement plate 23 of a predetermined thickness is brought into contact with the lower surface of the web of the upper frame member 12.

Bolts 24 are inserted through holes bored through the contact portions of the respective members and fastened with nuts 25, whereby the peripheral beam 5*b* of the H-shaped steel (heavyweight steel frame) is fastened to the upper end of the SH panel 9*a* formed of a construction surface member 13 fixed with the wall frame panel 9.

FIG. 2(C) illustrates an example in which a center of the peripheral beam 5*b* of the H-shaped steel (that is, a web 26) coincides with a thickness center of the SH panel 9*a* and both sides of the web 26 are fastened to the SH panel 9*a* by the bolts 24 and nuts.

FIG. 2(B) illustrates another example in which a center of the peripheral beam 5*b* of the H-shaped steel (that is, a web 26) is shifted from a thickness center of the SH panel 9*a* for the reason of design and one side of the web 26 is solely fastened to the SH panel 9*a* by the bolt 24 and a nut.

For example, in FIG. 2(A), a horizontal additional frame 27 of thin steel sheet channel is arranged above a relatively large opening 15 and fixed at opposite ends thereof to the vertical frame members 11. Vertical additional frames 28 are provided between the horizontal additional frame 27 and the peripheral beam 5*b* of the H-shaped steel. These additional frames 27 and 28 have no function for transmitting the vertical load from the upper region of the opening 15 to the vertical members 11 of the SH panel 9*a*.

Figure 4:
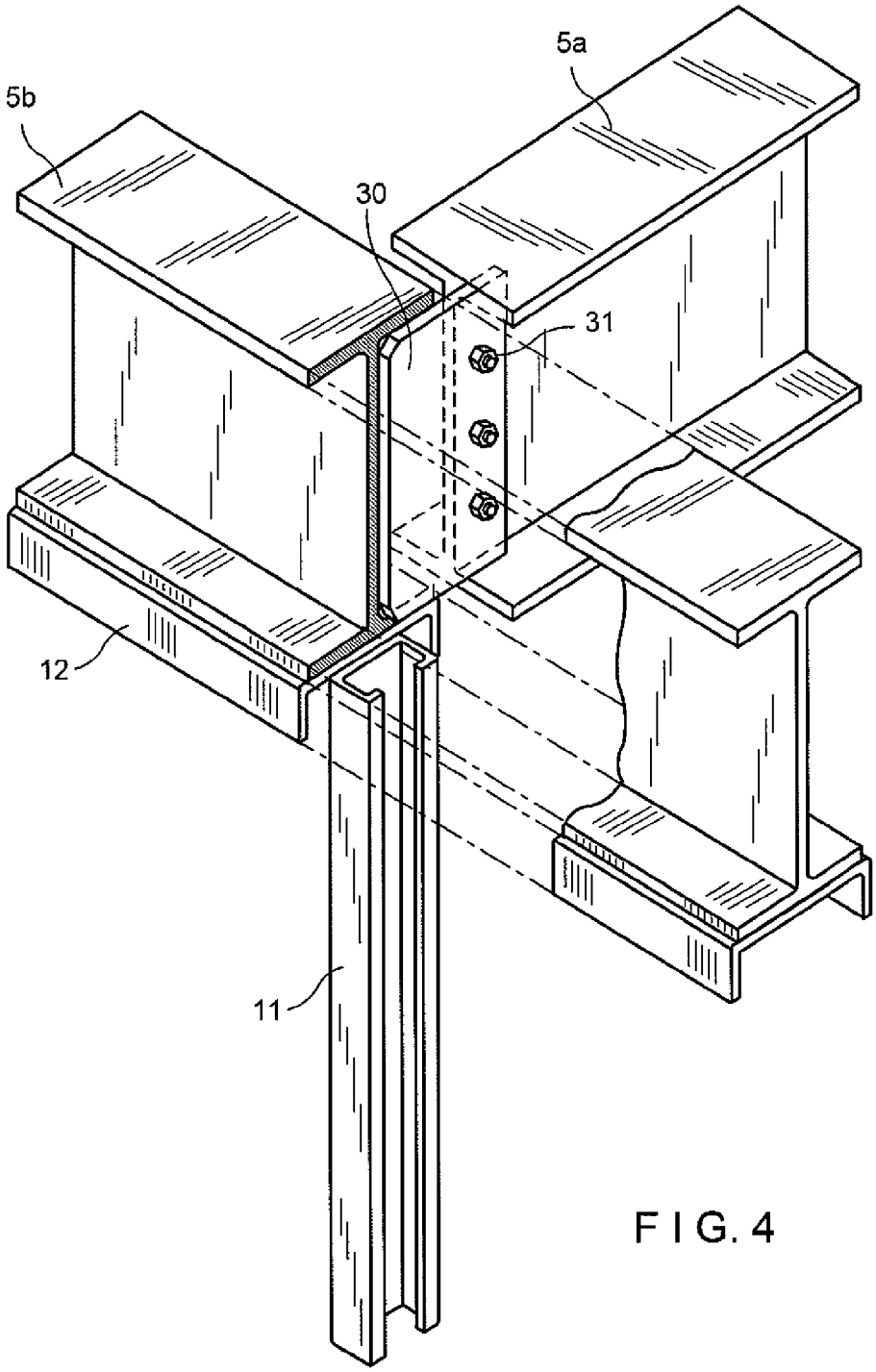
FIG. 4 is an illustration of an exemplary structure of the coupling between the SH panel and the peripheral beams shown in FIG. 3.

When the SH panel is coupled to the beams as shown in FIGS. 3 and 4, as an arrangement for coupling the left and right peripheral beams 5*b* provided at the upper end of the SH panel 13 to the girder 5*a* of the H-shaped steel bridged between the two, a coupling plate 30 is welded to a groove section encircled by the upper and lower flanges of the peripheral beam 5*b* of the H-shaped steel and the web, and the coupling plate 30 is brought into contact with a lateral side of the web of the H-shaped steel in the girder 5*a*. Bolts 31 are inserted through holes formed in the contact portion and fastened with nuts, whereby opposite ends of the girder 5*a* are fixed to the peripheral beam 5*b*.

According to the above coupling structure, it is possible to smoothly transmit the vertical load from the roof 6 or the like to the vertical frame members 11 of the SH panel 9*a* as well as to endure a large withdrawing force applied to the peripheral beam 5*b*.

Figure 5A:
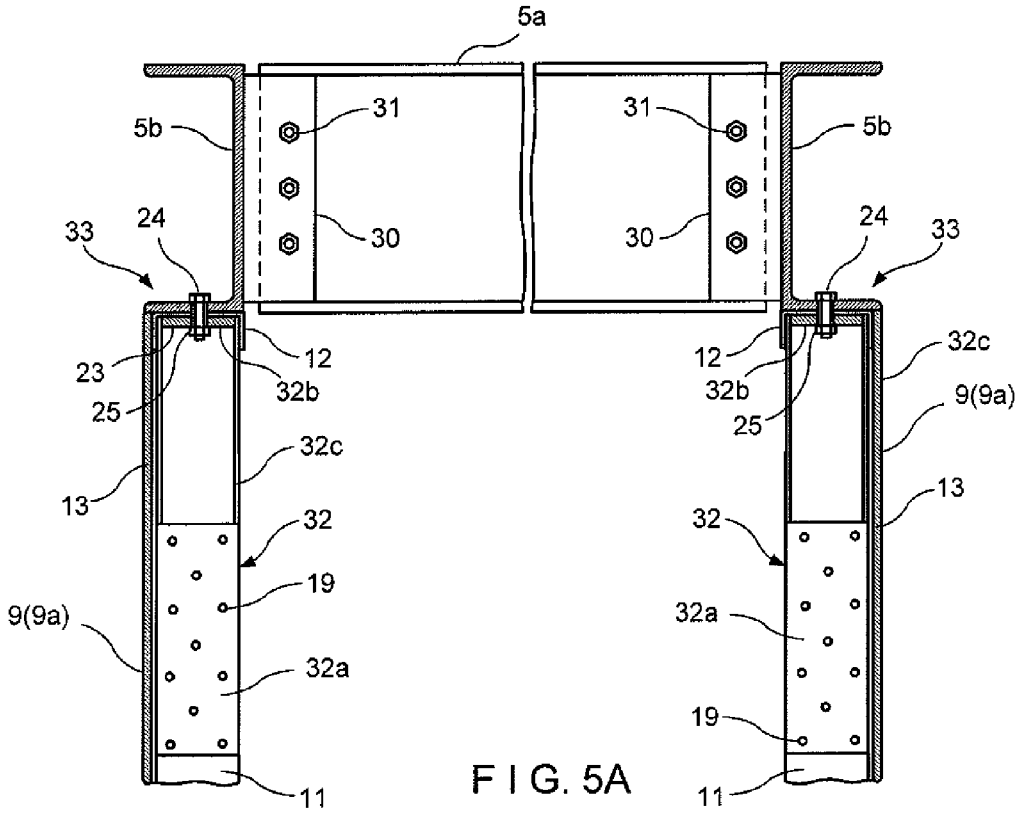
FIG. 5(A) is an illustration of a first example as to how the SH panel and the beams (the peripheral beams and the girder) are coupled.
Figure 5B:
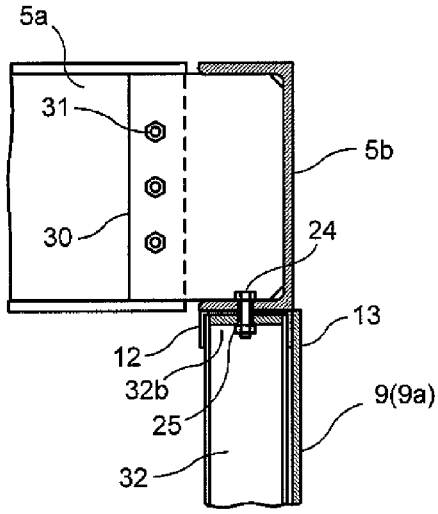
FIG. 5(B) is an illustration of a second example as to how the SH panel and the beams (the peripheral beams and the girder) are coupled.
Figure 6:
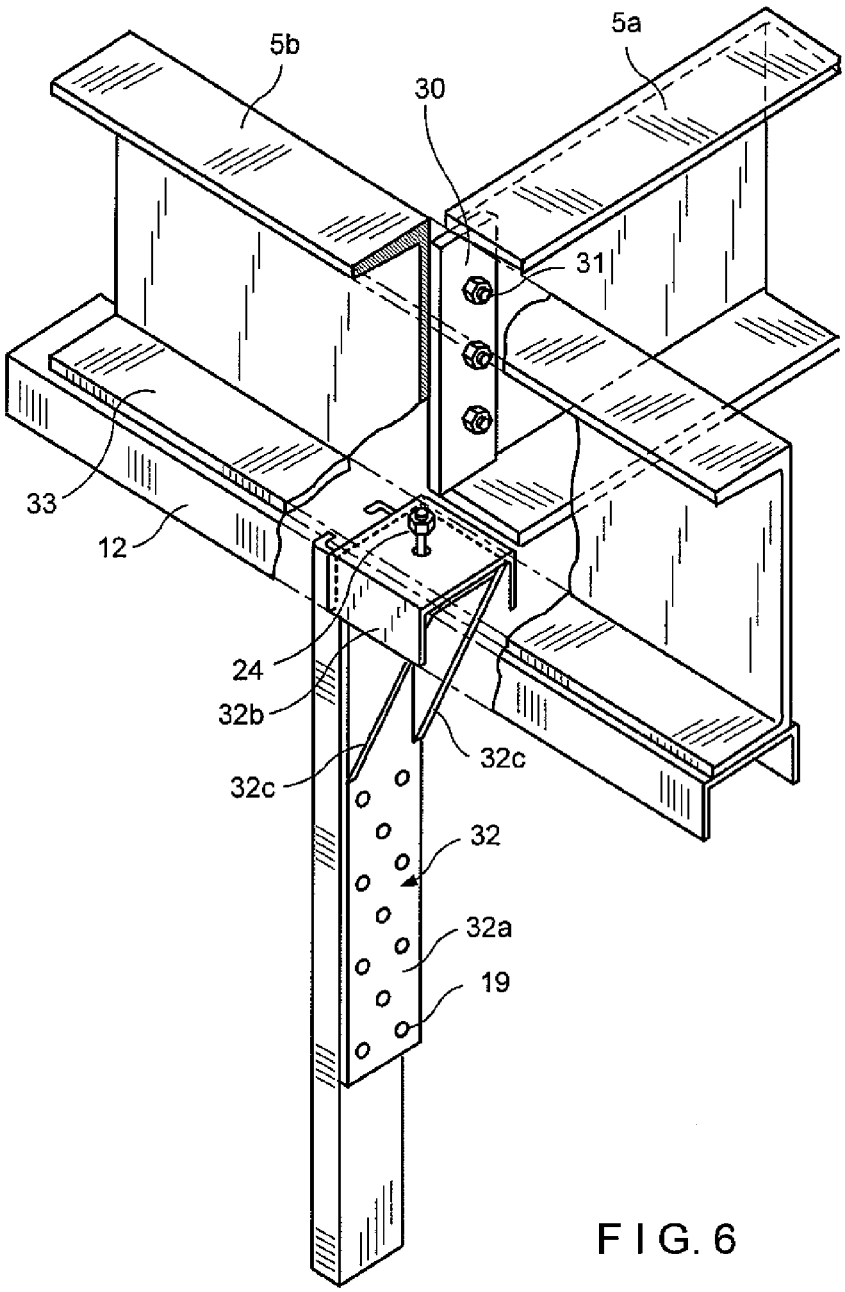
FIG. 6 is an illustration of an exemplary structure of the coupling between the SH panel and the peripheral beams shown in FIGS. 5(A) and 5(B)

FIGS. 5 and 6 illustrate a second exemplary embodiment in which the peripheral beam 5*b* of heavyweight steel frame is constructed by a channel. Also in this second exemplary embodiment, a coupling method can smoothly transmit a force between the SH panel 9*a* and the peripheral beams 5*b*. According to the second exemplary embodiment, this coupling arrangement is formed of a hold-down fastener.

In order to connect the upper ends of a plurality of vertical frame members 11, the upper surface of the web of the upper frame member 12 of thin steel sheet disposed downward at the upper end of the vertical frame member 11 is brought into contact with a lower flange 33 of the peripheral beam 5*b* formed of a channel.

On the other hand, a vertical plate 32*a* of the hold-down fastener 32 can be brought into contact with a back surface of the web of the vertical frame member 11 formed of thin steel sheet. Holes may be formed in the contact portion, into which are inserted drill screws 10 to fasten both the members.

At this time, a horizontal plate 32*b* provided at the upper end of the hold-down fastener 32 via a reinforcement plate 32*c* is positioned in the lower surface of the web of the upper frame member 12.

The bolt 24 is inserted into a hole bored upward and downward through the contact portion between the lower flange 33 of the peripheral beam 5*b* of channel brought into contact with the upper surface of the web of the upper frame member 12 and the horizontal plate 32*b* of the hold-down fastener 32 and fastened to the nut 25, whereby the peripheral beam 5*b* formed of a channel is fixed to the upper end of the SH panel.

Also, in the second exemplary embodiment, it is possible to transmit a force between the SH panel 9*a* and the peripheral beam 5*b* via the hold-down fastener 32 so that a vertical load from the roof 6 or the like is smoothly transmitted to the vertical frame member 11 of the SH panel 9*a*, whereby the peripheral beam 5*b* is durable against a large withdrawal force applied thereto.

The rest of the construction may be the same as that of the first exemplary embodiment. In this regard, as a modification of the second exemplary embodiment, the peripheral beam 5*b* formed of channel may be disposed opposite to FIG. 5(A) as shown in FIG. 5(B) so that the back surface of the web is located outside.

The first and second exemplary embodiments may also be combined with each other. That is, as an arrangement for coupling the peripheral beam 5*b* to the SH panel 9*a*, a combination may be used in which the peripheral beam 5*b* formed of the H-shaped steel is coupled to the SH panel 9*a* by the hold-down fastener 32 and the bolt 24 of the first exemplary embodiment. Also, a combination may be used in which the peripheral beam 5*b* formed of the channel is coupled to the SH panel 9*a* by the bolt 31 of the second exemplary embodiment.

Next, a combination of a peripheral beam (e.g., a girder) 5*b* formed of heavy weight steel frame and an SH panel (e.g., a force-resisting wall) 9*a*, for the purpose of freely providing an opening 15, is shown in FIGS. 7(A) to 7(D).

FIG. 7(A) is an example in which the SH panels 9*a* are arranged in a well-balanced manner when the width of the opening is not so large and the continuity of a sash is unnecessary.

FIG. 7(B) is an example in which reinforcement pillars 35 of heavyweight steel frame are provided along the SH panels 9*a* disposed at opposite sides of the opening 15 when the stud cannot be disposed midway because a large opening is necessary for a shutter or the like.

FIG. 7(C) is an example in which a stud 34 of heavyweight steel frame is disposed at a midpoint of the opening 15 when the continuity of a sash is required.

FIG. 7(D) is an example in which the continuity of a sash is maintained while increasing or decreasing the number of studs 34 of heavyweight steel frame in accordance with the width of the opening.

In this regard, it may be preferable to employ a method for coupling the stud 34 of heavyweight steel frame to the peripheral beam 34 of the base is selected from either pinning method or fixing method in view of a balance of the entirety of the building or others.

Figure 8:
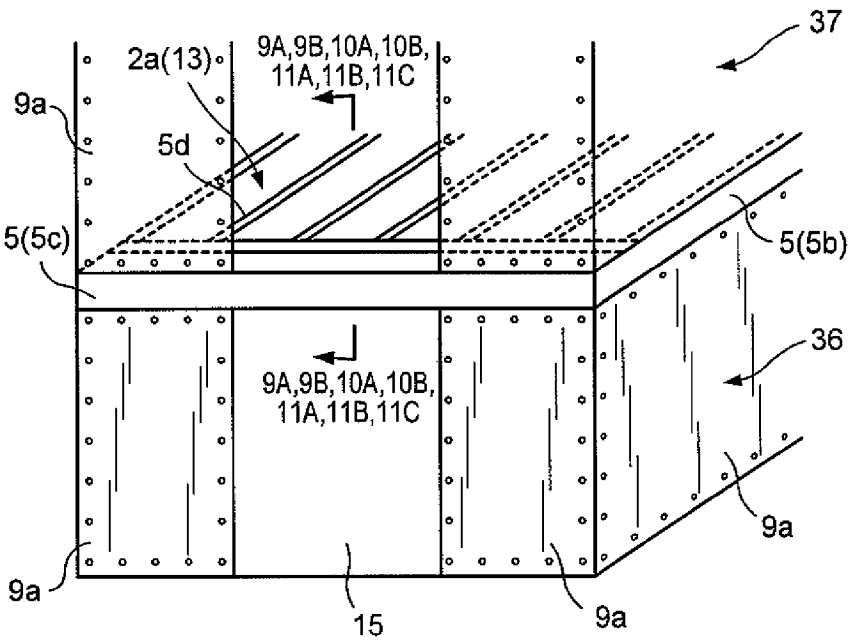
FIG. 8 is an illustration of another exemplary embodiment of the present invention (which is embodied in a two-storied building)
Figure 12:
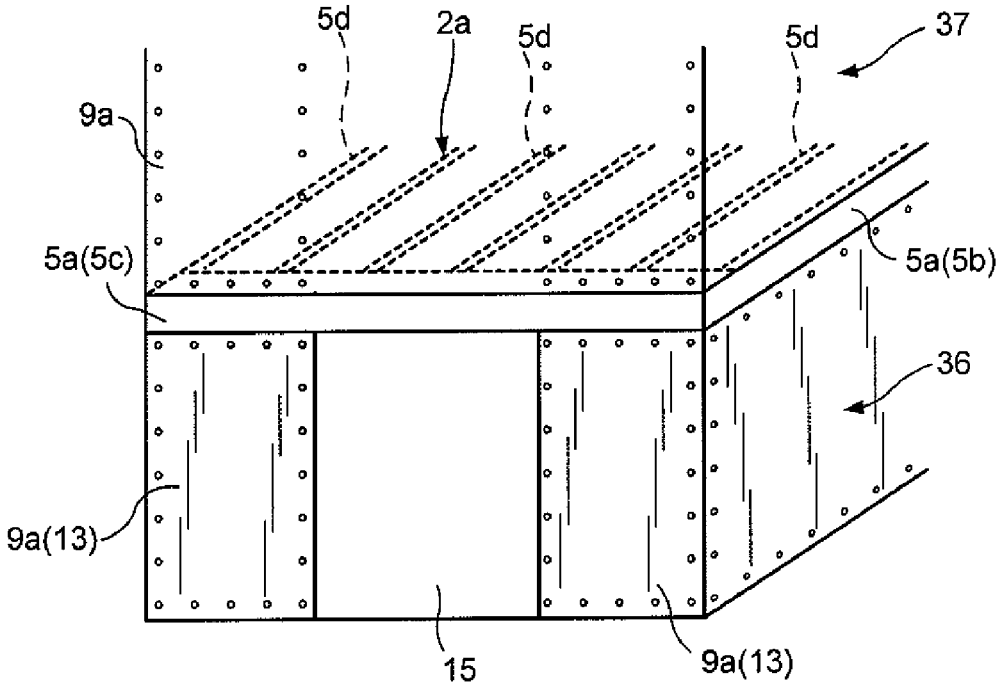
FIG. 12 illustrates another example (e.g., a two-storied building) according to a further exemplary embodiment of the present invention.
Figure 13:
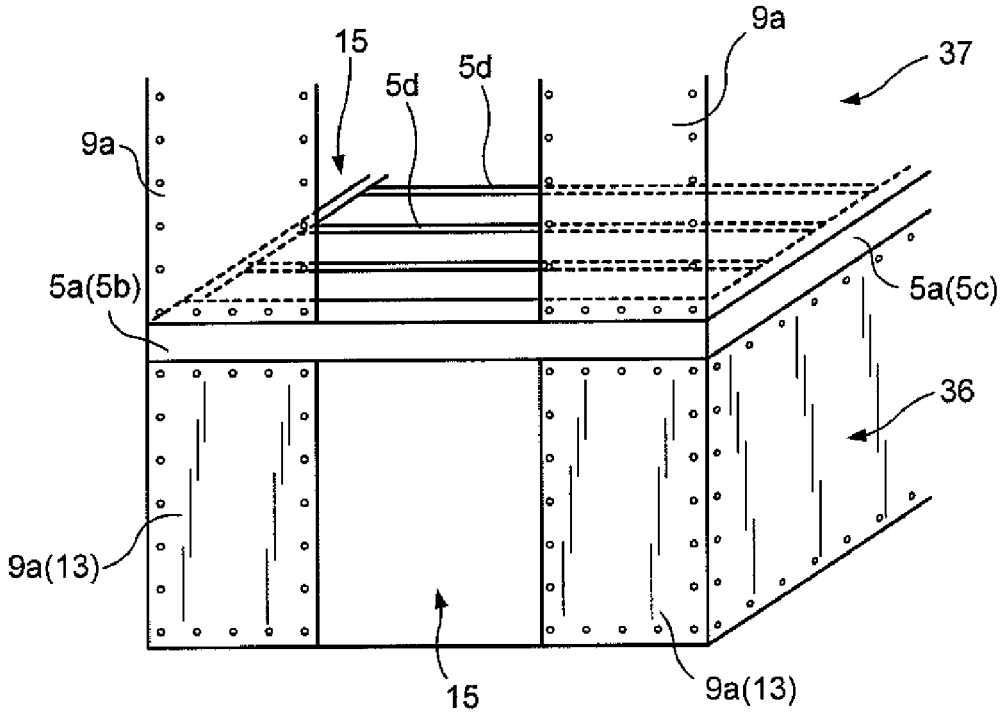
FIG. 13 illustrates a further example (e.g., a two-storied building) according to a further exemplary embodiment of the present invention.
Figure 14:
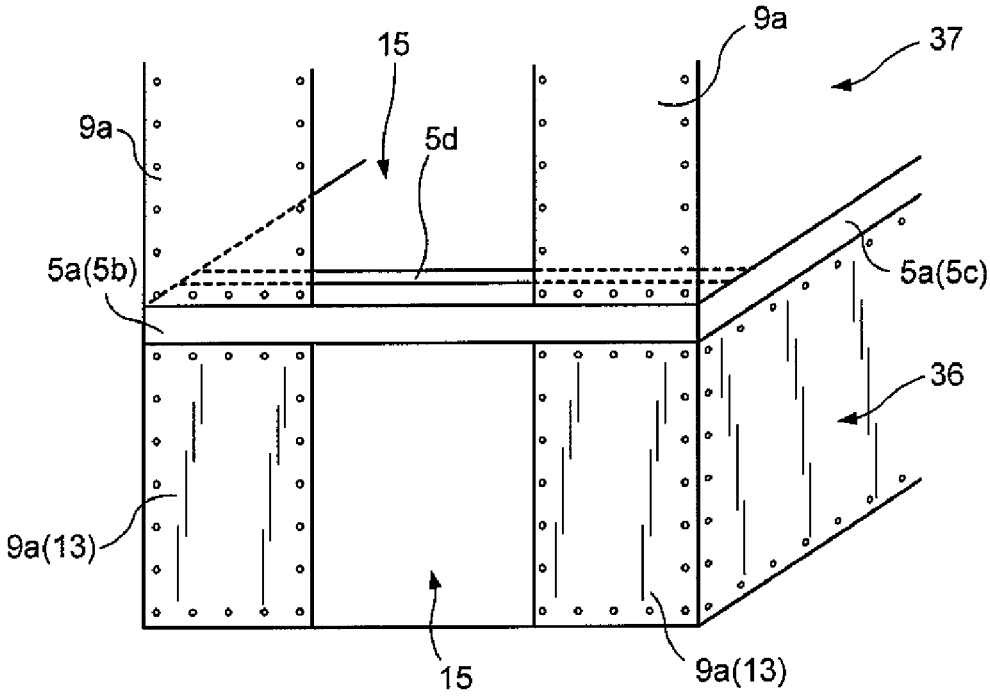
FIG. 14 illustrates a further example (e.g., a two-storied building) according to the a further exemplary embodiment of the present invention.

FIG. 8 illustrates an exemplary embodiment (e.g., a two-storied building) of the present invention (defined by claims 8 to 17). FIGS. 12, 13 and 14 illustrate other exemplary embodiments of the present invention.

According to the exemplary embodiments of the present invention (e.g., buildings) shown in FIGS. 8 and 12-14, walls of a ground floor 36 and a second floor 37 are constructed by SH panels (force-resisting wall panels) 9*a*, in which the force-resisting wall panels 9*a* for the second floor 37 and floor beams 5*d* are supported by side beams 5*b* and end beams 5*c* (both are referred to as beams 5) arranged along the upper ends of the force-resisting wall panels 9*a* for the ground floor, and a floor panel 2*a* can be constructed by bonding a construction surface member (plywood panel) 13 to the floor beams 5*d*.

In FIGS. 8 and 12, an opening 15 is provided in a wall vertical to the floor beams 5*d* while, in FIG. 13, the opening 15 is provided in a wall parallel to the floor beams 5*d*. Further, FIG. 12 illustrates an example of the present invention which has no opening (i.e., referenced as 15) in the upper floor, while FIGS. 8 and 13 illustrate other examples having an opening 15 in the upper floor.

FIG. 14 illustrates an arrangement of the force-resisting wall panels 9*a*. This force-resisting wall panel 9*a* can be structured as shown in FIGS. 15(A) and 15(B).

Figure 15A:
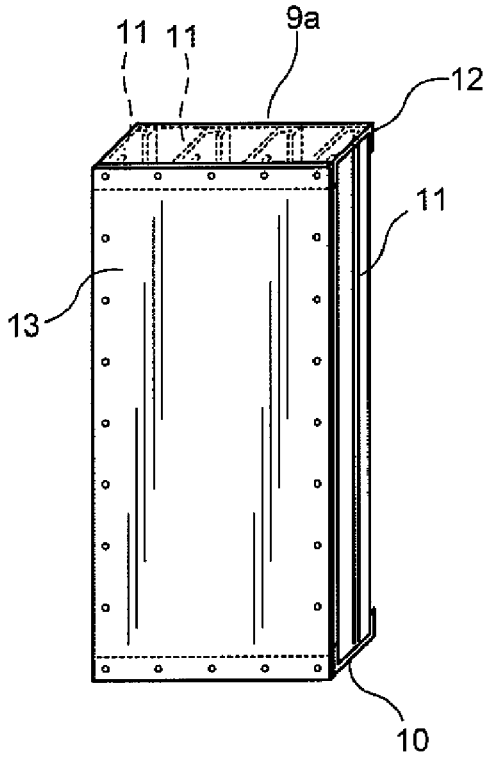
FIG. 15 illustrates a force resisting walls.

In the example shown in FIG. 15(A), the force-resisting wall panel 9*a* is structured by assembling a wall frame member with a lower frame member 10 of thin light-gauge section steel, vertical frame members 11 of thin light-gauge section steel and an upper frame member 12 of thin light-gauge section steel and fixing a construction surface member 13 thereto by drill screws 19.

Figure 15B:
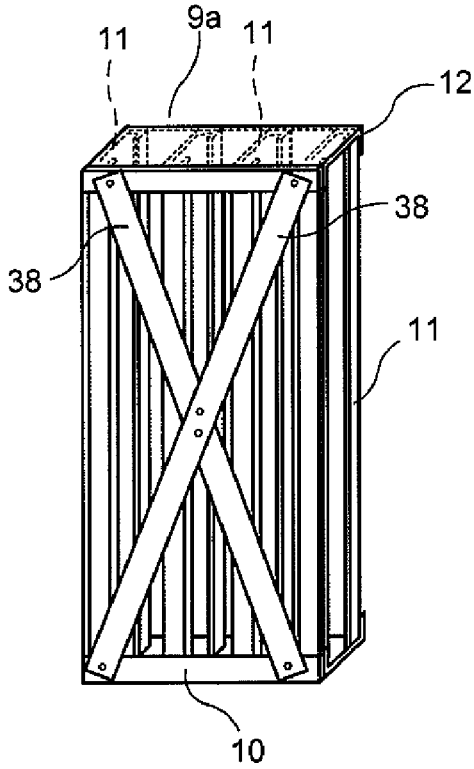
Figure 16:
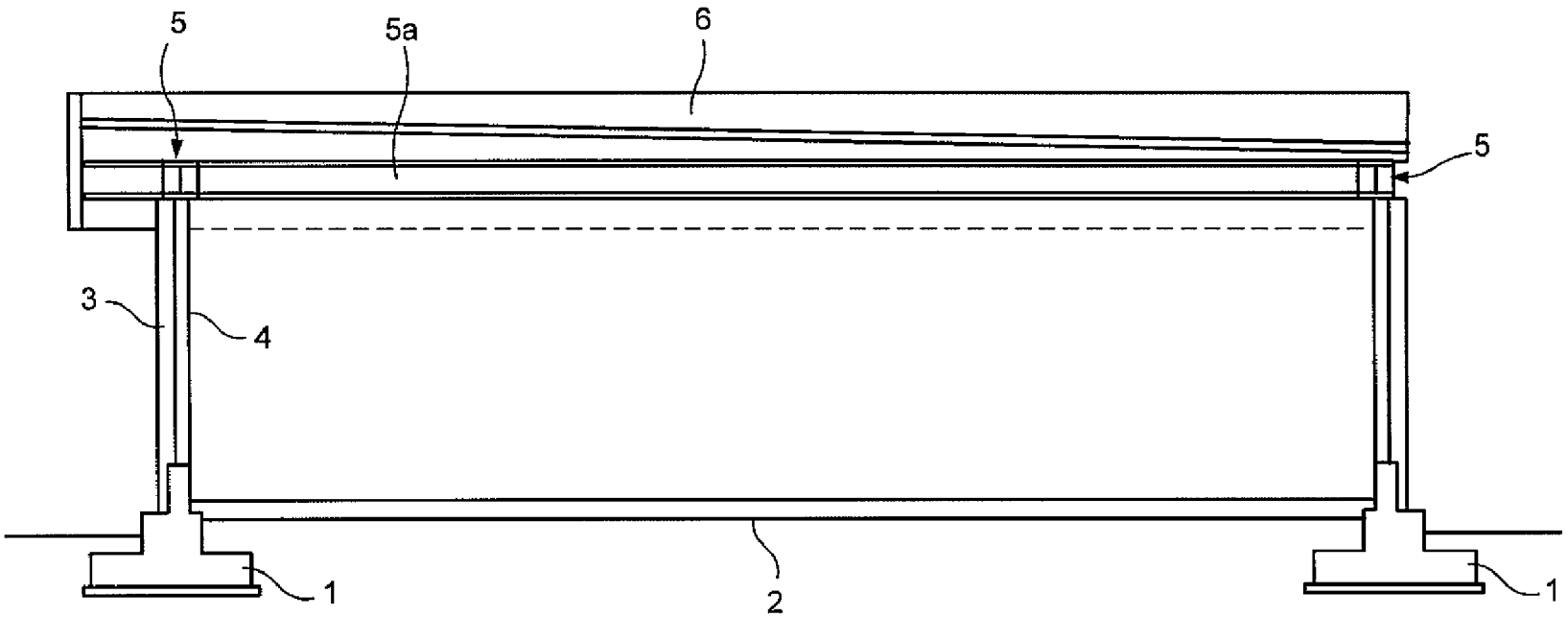
FIG. 16 PRIOR ART
FIG. 16 illustrates a sectional view of a single-storied building constructed by a steel frame work method which is a first prior art method.
Figure 17:
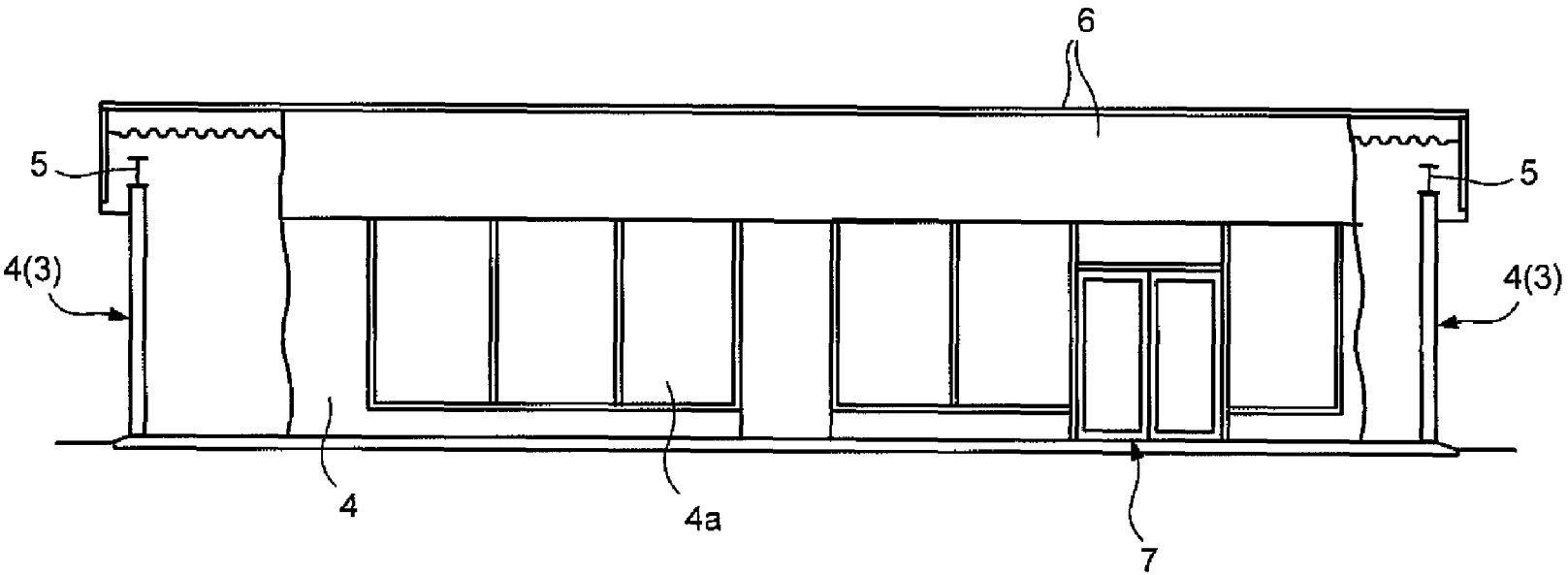
FIG. 17 PRIOR ART
FIG. 17 is a front view of the single-storied building shown in FIG. 16.
Figure 18:
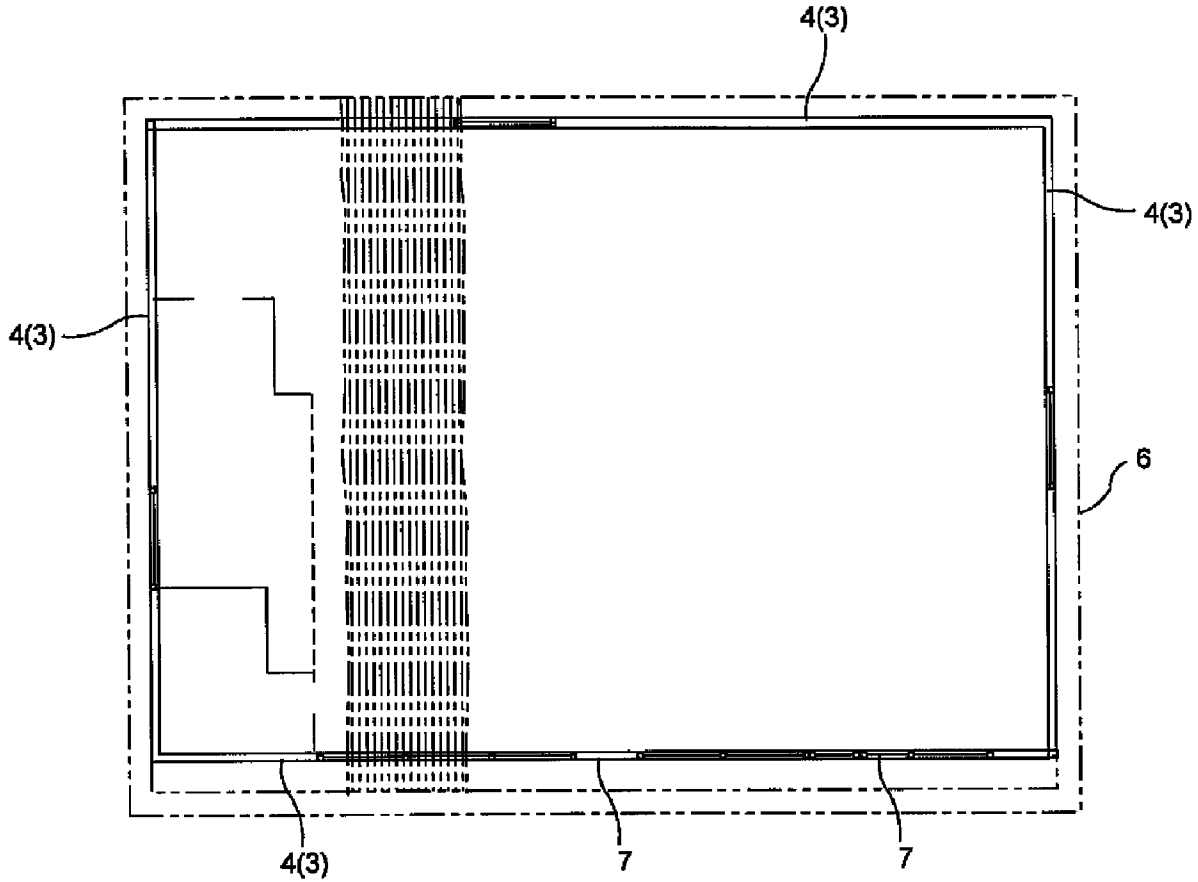
F I G. 18 PRIOR ART
FIG. 18 is a sectional plan view shown in FIG. 16.
Figure 19:
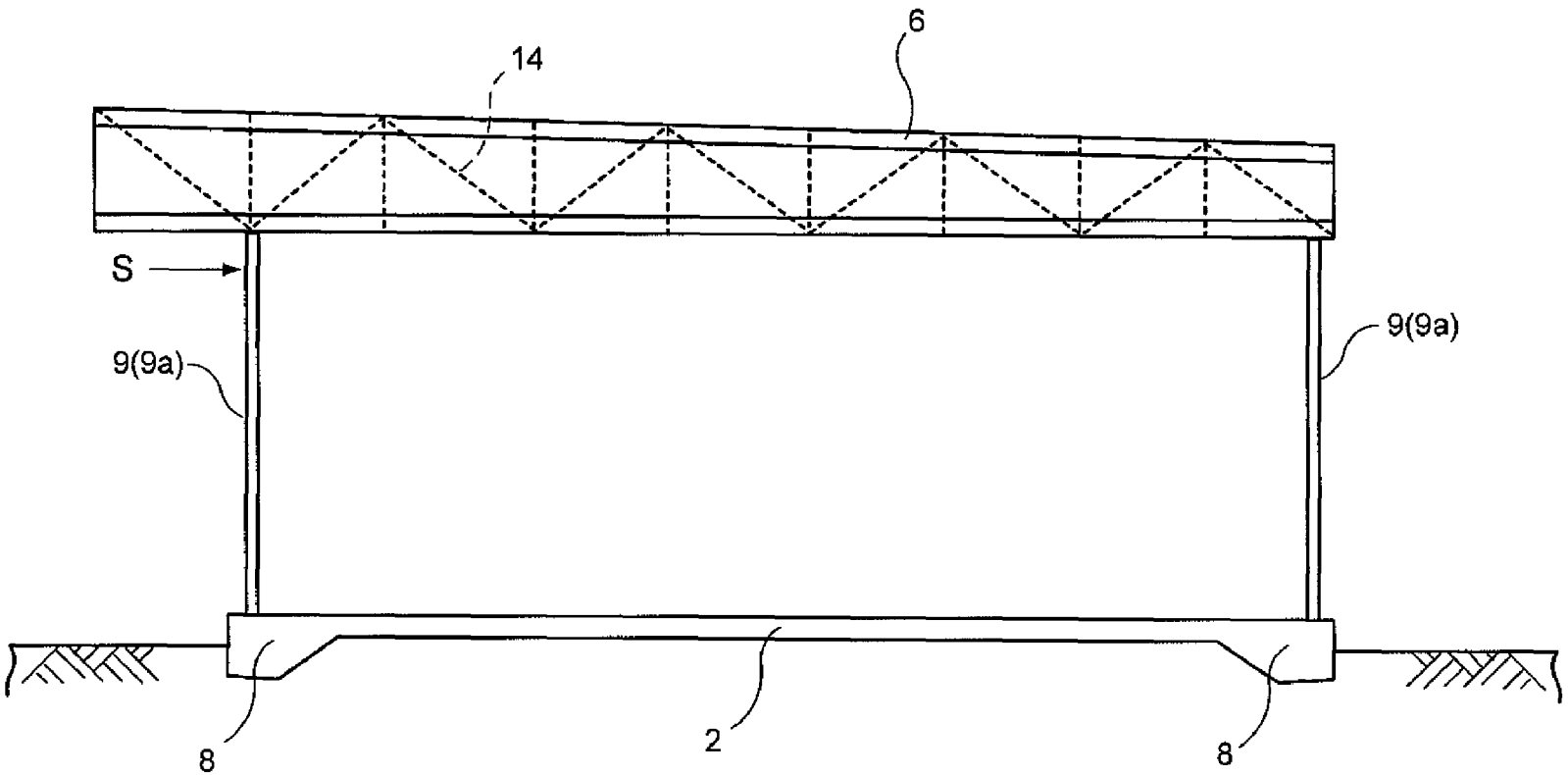
FIG. 19 PRIOR ART
FIG. 19 illustrates a sectional view of a single-storied building constructed by an SH (steel house) method which is a second prior art method.

In the example of the force-resisting wall panel 9*a* shown in FIG. 15(B), braces 38 are welded or fixed by drill screws 19 to the above-mentioned wall frame member structured by assembling the lower frame member 10, the vertical frame members 11 and the upper frame member 12.

According to another exemplary embodiment of the present invention, either of the force-resisting wall panel 9*a* shown in FIG. 15(A) or 15(B) may be used. In this regard, in place of the wall frame member of thin light-gauge section steel, the force-resisting wall panel may be constructed by wooden frame members and the surface member (plywood).

One of the objects of the present invention is to eliminate a conventional lintel in the opening 15 by using the girder 5*a* of a special structure in a two or three-storied building constructed by the SH method, in which the coupling structure of three members, the force-resisting wall panel 9*a*, the girder 5*a* and the floor panel 2*a*, constitutes part of the main construction.

Figure 9A:
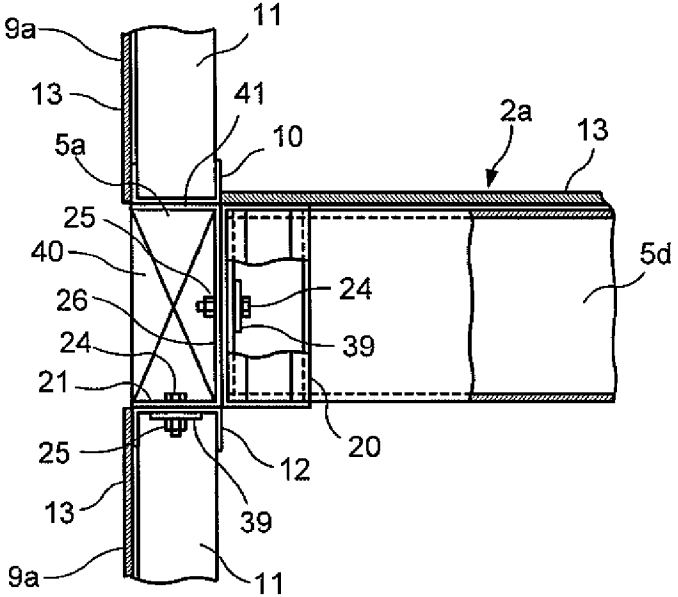
FIG. 9(A) is a sectional view of an exemplary section taken along a line B-B in FIG. 8.
Figure 9B:
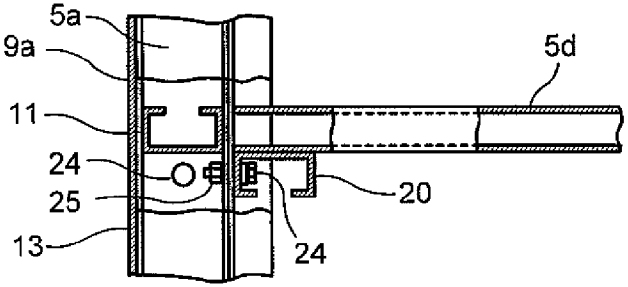
FIG. 9(B) is a plan view of the exemplary section taken along a line B-B in FIG. 8.
Figure 10A:
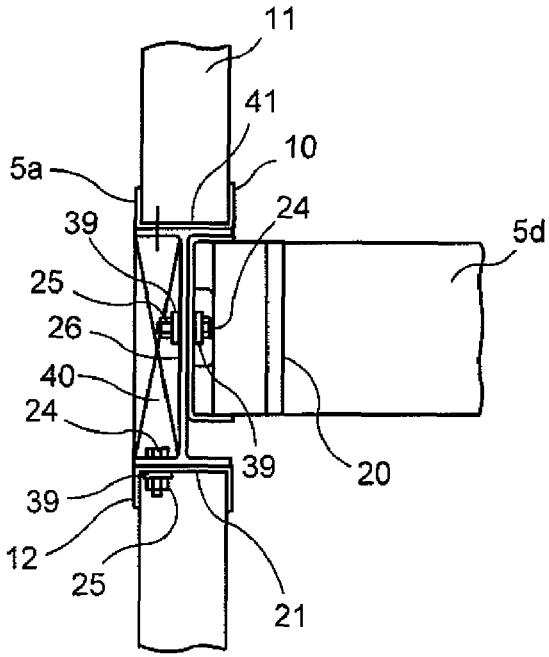
FIG. 10(A) is an illustration of an example of the section taken along the line B-B in FIG. 8.
Figure 10C:
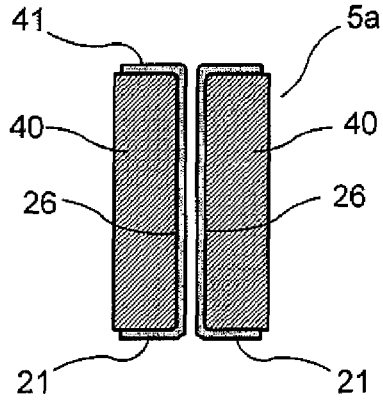
FIG. 10(C) is an illustration of a beam and a reinforcement member illustrated in FIG. 10(B)

FIGS. 9 to 11 illustrate six examples in which the force-resisting wall panel 9*a*, the girder 5*a* and the floor panel 2*a* are coupled together. These six examples may be classified into three types in accordance with the structure of the girder 5*a*, and further into two kinds in accordance with the combination of the three members. Thus, in the drawings, the six examples are shown in total.

Figure 10B:
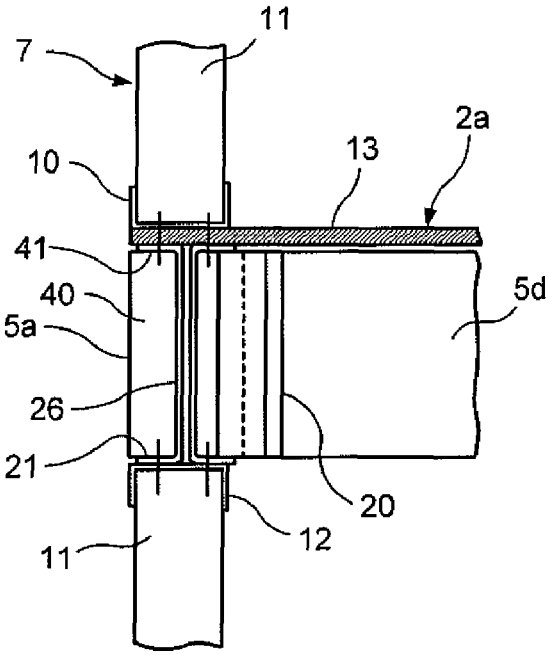
FIG. 10(B) is an illustration of another example of the section taken along the line B-B in FIG. 8.
Figure 11C:
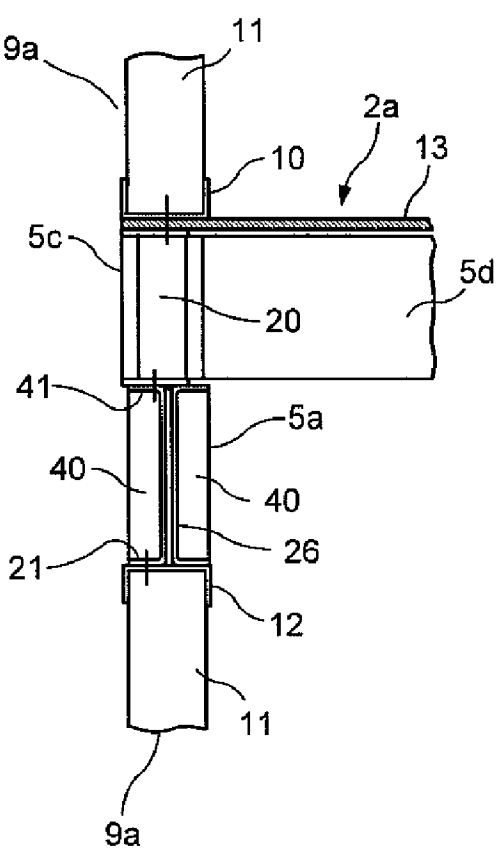
FIGS. 11(B) and 11(C) are illustrations of second and third examples of yet another section take along the line B-B in FIG. 8.
Figure 11B:
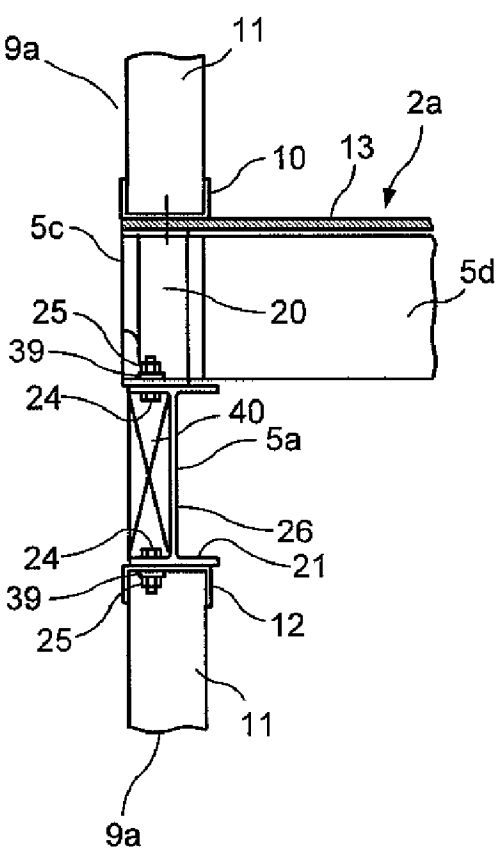
Figure 11A:
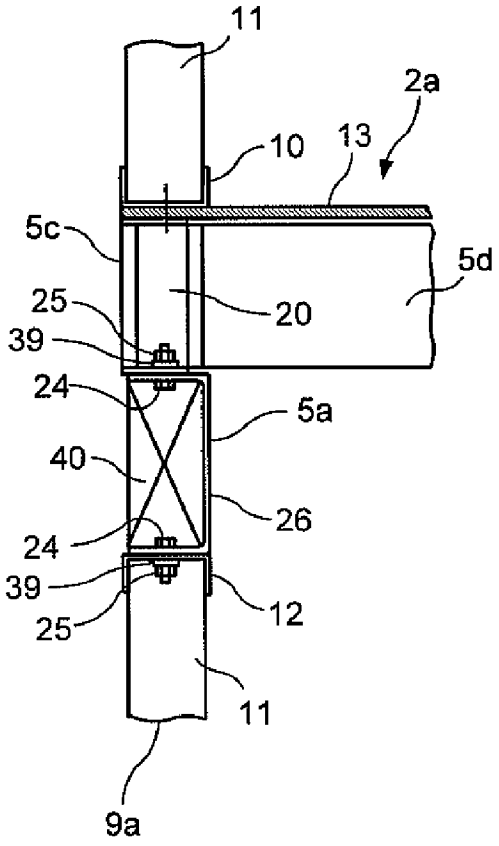
FIG. 11(A) is an illustration of a first example of yet another section taken along the line B-B in FIG. 8.

In FIG. 9, a first example is illustrated, in which a girder (also called a peripheral beam) 5*a* is coupled to three members of a floor panel 2*a*. FIGS. 10(A) and 10(B) illustrate second and third examples; while FIGS. 11(A), 11(B) and 11(C) illustrate fourth, fifth and sixth examples, respectively.

In the third example (see FIG. 3(B)), a coupling structure is illustrated, in which vertical and horizontal forces applied to the opening 15 formed in the wall are relatively small, for example, when the opening 15 is disposed on the wall surface parallel to the floor beam 5*d*. In the first, second and fourth to sixth examples, coupling structures are illustrated, in which vertical and horizontal forces applied to the opening 15 formed in the wall are relatively large, for example, when the opening is disposed on the wall surface vertical to the floor beam 5*d*.

Constituent elements common to the first to sixth examples will be explained with reference to FIGS. 9 to 11.

The girder 5*a* is constructed of: (i) a channel steel in FIGS. 9 and 11(A), (ii) an H-shaped steel in FIGS. 10(A) and 11(B); and (iii) a combination member, in which two thin light-gauge channels are coupled in a back-to-back relationship, in FIGS. 10(B) and 11(C). In the girder 5*a* provided on the wall surface having the opening 15 parallel to the floor beam 5*d*, as shown in FIGS. 9, 10(A) and 10(B), the floor beam 5*d* is coupled to the lateral side of the girder 5*a* by bolts.

In the girder 5*a* provided on the wall surface having the opening 15 vertical to the floor beam 5*d*, as shown in FIGS. 11(A), 11(B) and 11(C), the floor beam 5*d* is placed on the upper surface of the girder 5*a* and coupled by bolts.

Detailed structures shown in FIGS. 9 to 11 are described as follows.

In the first example shown in FIG. 9, at the upper end of a force-resisting wall panel 9*a*, a lower flange 21 of a circumferential girder 5 formed of a channel which is disposed so that the web 26 is vertical and the channel portion that is outward is brought into contact with the upper surface of the web of an upper frame member 12 formed of thin light-gauge channel in a force-resisting wall panel 9*a*, and a bracing plate 39 is disposed on the lower surface of the web.

Through the respective members in the coupling portion, bolts 24 are provided and screw-engaged with nuts 25. Thus, the force-resisting wall panel 9*a* is coupled to the girder 5*a*.

A bracket 20 provided at an end of the floor beam 5*d* is brought into contact with a back surface of the web in the circumferential beam 5 formed of channel steel. This bracket 20 is formed of a lipped channel of thin steel sheet cut into short pieces and is coupled to an end of the floor beam 5*d* in the vertical posture so that one flange thereof is brought into contact with a back surface of the web in the girder 5*a*. A bolt 24 is inserted through the contact portion via a bracing plate 39 and screw-engaged with a nut 25.

Thus the floor beam 5*d* is coupled to the girder 5*a*. In the channel portion of the girder 5*a*, a reinforcement member 40 is provided.

As described before, the floor panel 2*a* is structured by the floor beams 5*d* on which the construction surface member 13 is bonded. On the upper flange 41 of the girder 5*a*, the lower frame member 1 of thin light-gauge channel in the force-resisting wall panel 7 in the upper floor is placed and fixed by bolts.

Next, in the second example shown in FIG. 10(A), at the upper end of the force-resisting wall panel 9*a*, a lower flange 21 of the girder 5*a* formed of H-shaped steel, disposed so that the web 26 thereof extends in the vertical direction, is brought into contact with the upper surface of a web of the upper frame member 12, and the bracing plate 39 is provided on the lower surface of the web.

A bolt 24 is inserted into a hole bored through these members and fastened to a nut 25 to couple the force-resisting wall panel 9*a* to the girder 5*a*. The bracket 20 provided at the end of the floor beam 5*d* is brought into contact with a back surface of the web of the girder 5*a* formed of H-shaped steel. The remaining structure is the same as the first example shown in FIG. 9.

In the third example shown in FIG. 10(B), the girder 5*a* is constructed by a combination of two members formed of thin light-gauge channel steel coupled so that the back surfaces thereof are opposed to each other.

The lower flange 21 of the girder 5*a*, disposed so that the web 26 thereof extends in the vertical direction, is brought into contact with the upper surface of the web of the upper frame member 12 formed of thin light-gauge channel steel in the force-resisting wall panel 9*a*, and the respective members in the contact portion are coupled to each other by bolts or drill screws, whereby the force-resisting wall panel 9*a* is coupled to the girder 5*a*. In the channel of the girder 5*a* formed of the combination of the thin light-gauge channel steel members, the reinforcement member 40 is provided. The remaining structure is the same as the first example shown in FIG. 9.

In the first to third examples, as the girder 5*a* high in rigidity formed of heavyweight steel such as channel or H-shaped steel or the combined member of thin light-gauge channel steel is provided above the force-resisting wall panel 9*a* on the wall surface having the opening 15 (see FIG. 1), the girder 5*a* functions as an lintel in the prior art without any problems.

Thus, even if the lintel is omitted from the opening in the conventional steel house construction method, it is possible to sufficiently support the vertical load from the upper floor or the horizontal force.

Also, as the vertical force and the horizontal force supported by the girder 5*a* provided in the wall having the opening 15 parallel to the floor beam 5*d* are relatively small in comparison with the vertical arrangement, it is possible to ensure a sufficient supporting force even if the end of the floor beam 5*d* is coupled to the lateral side of the girder 5*a*.

FIGS. 11(A), 11(B) and 11(C) illustrate fourth, fifth and sixth examples, respectively, in which the girder 5*a* on the force-resisting wall panel 9*a* is coupled to the floor beam 5D on the wall surface having the opening disposed vertical to the floor beam 5D. In either case, the end of the floor beam 5D is placed on the girder 5*a* and coupled thereto by bolts.

The girder 5*a* shown in FIGS. 11(A), 11(B) and 11(C) has the same structure as the girder 5*a* shown in FIGS. 9, 10(A) and 10(B). Also, the coupling structure thereof with the upper end of the force-resisting wall panel 9*a* may be the same as that shown in the above-identified figures. The floor beam 5D has the same structure as the floor beam 5D shown in FIGS. 9, 10(A) and 10(B).

As shown in FIG. 11(A), the end beam 5*c* formed of thin light-gauge channel steel and coupled with the floor beam 5*d* is placed on the upper surface of the upper flange 41 of the girder 5*a* formed of channel steel.

The bolt 24 is provided through the coupling portion of the upper flange 41, the thin light-gauge channel steel member and the bracing plate 39 and fastened to the nut 25, whereby the girder 5*a* is coupled to the floor beam 5D. On the upper surface of the end of the construction surface member 13 bonded to the upper surface of the floor beam 5D, the lower frame member 10 formed of thin light-gauge channel steel in the force-resisting wall panel 9*a* in the upper floor is placed and fastened by bolts.

As shown in FIG. 11(B), the end beam 5*c* formed of thin light-gauge channel steel and coupled with the floor beam 5*d* is placed on the upper surface of the upper flange 41 of the girder 5*a* formed of channel steel. The bolt 24 is provided through the coupling portion of the upper flange 41, the thin light-gauge channel steel member and the bracing plate 39 and fastened to the nut 25, whereby the girder 5*a* is coupled to the floor beam 5D.

On the upper surface of the end of the construction surface member 13 bonded to the upper surface of the floor beam 5D, the lower frame member 10 formed of thin light-gauge channel steel in the force-resisting wall panel 9*a* in the upper floor is placed and fastened by bolts.

As shown in FIG. 11(C), the end beam 5*c* formed of thin light-gauge channel steel and coupled with the floor beam 5*d* is placed on the upper surface of the upper flange 41 of the girder 5*a* formed of the combined members of thin light-gauge channel steel. The bolt 24 is provided through the coupling portion of the upper flange 41, the thin light-gauge channel steel member and the bracing plate 39 and fastened to the nut 25, whereby the girder 5*a* is coupled to the floor beam 5D.

A reinforcement frame 42 formed of thin light-gauge channel steel is provided on the outside surface of the end beam 5*c*, and the lower frame member 10 formed of thin light-gauge channel steel in the force-resisting wall panel 9*a* in the upper floor is placed on the upper surface of the end of the construction surface member 13 bonded to the upper surface of the floor beam 5*d* and coupled by bolts.

Also, in the fourth to sixth examples, as the girder 5*a*, high in rigidity and formed of heavyweight channel steel or H-shaped steel or the combined member of thin light-gauge channel steel, may be provided on the wall surface having the opening 15 (see FIG. 14), the girder 5*a* can function as an lintel in the prior art without any problems.

Thus, even if the lintel is omitted from the opening in the conventional steel house construction method, it is possible to sufficiently support the vertical load, from the upper floor, or the horizontal force.

Also, in the fourth to sixth examples, as the floor beam 5*d* is supported on the girder 5*a*, no shearing force is applied to the bolt 24, and sufficient supporting force may be obtained even though the vertical or horizontal force to be supported by the girder 5*a* provided in the wall having the opening 15 disposed vertical to the floor beam 5*d*.

In this regard, according to an exemplary embodiment of the present invention, the structure of the respective portion and the fastening member (bolt, rivet or drill screw) may be suitably changed in accordance with loads applied to the girder, which changes in design should be understood by those of ordinary skill in the art as being completely disclosed by the description and drawings referenced herein.

CAPABILITY OF EXPLOITATION IN INDUSTRY

According to an exemplary embodiments of the present invention, while maintaining the advantages of the steel house method in the construction of a low-rise building mainly using frame members formed of thin light-gauge section steel, in that no welding is necessary, the cutting and boring are simple, the material is light in weight and capable of being manually conveyed, the panel accuracy may be improved and/or ensured, the execution of work can be easier, the construction period may be short and the manufacturing cost may be low, the problems thereof, in that the strength is too weak to support a roof load, are solved by combining the members of thin light-gauge section steel with a horizontal beam member of heavyweight section steel, high in strength, which is simple in structure because the roof truss is unnecessary.

According to an exemplary embodiment of the present invention, as the circumferential beam on the force-resisting wall panel is formed of heavyweight section steel such as an H-shaped steel or a channel or the combination beam of thin light-gauge section steel, it is possible to omit the lintel member and thus to enlarge the height and width of the opening, while maintaining the merits of the conventional SH technology in that the roof and the floor panels are efficiently manufactured in a factory and the site work may be simplified.

We claim:

1. A frame construction arrangement for a low-rise building including a lower story and an upper story, comprising:

a component being at least one of a first construction surface member and a brace;

a first wall frame panel in the lower story, the first wall frame panel being formed by frame members composed of thin light-gauge section steel coupled to the component;

a girder formed from heavy-weight section steal provided above the first wall frame panel in the lower story, wherein the girder is coupled with the first wall frame panel by a bracing plate, bolts and nuts;

an end beam composed of thin light-gauge section steel coupled with a floor beam above the girder;

a second construction surface member provided above the floor beam; and a second wall frame panel in the upper story coupled with the second construction surface member; and wherein the frame construction arrangement forms an opening in a wall of the lower story, the opening extending to an area directly beneath the girder.

2. The arrangement according to claim 1, further comprising a reinforcement member provided in a channel of the girder, wherein the reinforcement member is coupled to the girder to reinforce the girder.

* * * * *